US007706730B2

(12) United States Patent
Akaike et al.

(10) Patent No.: US 7,706,730 B2
(45) Date of Patent: Apr. 27, 2010

(54) IMAGE RECORDING DEVICE HAVING A CHARGE PRODUCING SECTION UPSTREAM OF A TRANSFER RECEIVING BODY

(75) Inventors: Akitoshi Akaike, Saitama (JP); Naohisa Fujita, Saitama (JP); Satoru Hori, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 672 days.

(21) Appl. No.: 11/391,340

(22) Filed: Mar. 29, 2006

(65) Prior Publication Data

US 2007/0041756 A1 Feb. 22, 2007

(30) Foreign Application Priority Data

Aug. 19, 2005 (JP) ..... 2005-238824
Aug. 19, 2005 (JP) ..... 2005-238825

(51) Int. Cl.
*G03G 15/00* (2006.01)

(52) U.S. Cl. ..... 399/296; 399/44

(58) Field of Classification Search ..... 399/44, 399/296, 66

See application file for complete search history.

(56) References Cited

U.S. PATENT DOCUMENTS 5,339,144 A * 8/1994 Nakai et al. ..... 399/66
2003/0138277 A1* 7/2003 Naito ..... 399/310
2004/0071483 A1* 4/2004 Murakami et al. ..... 399/311
2007/0019995 A1 1/2007 Teraoka et al.

FOREIGN PATENT DOCUMENTS

JP 60000475 A * 1/1985
JP 02-163779 A 6/1990
JP 03267971 A * 11/1991
JP 04208970 A * 7/1992
JP 06118803 A * 4/1994
JP 07199688 A * 8/1995
JP 08044145 A * 2/1996
JP 08076607 A * 3/1996
JP 09160400 A * 6/1997
JP 10091011 A * 4/1998
JP 10268590 A * 10/1998
JP 11153916 A * 6/1999
JP 11-338276 A 12/1999
JP 2000075685 A * 3/2000
JP 2004170539 A * 6/2004
JP 2004-219711 A 8/2004
KR 2007-0010795 A 1/2007

* cited by examiner

*Primary Examiner*—Quana M Grainger
(74) *Attorney, Agent, or Firm*—Sughrue Mion, PLLC

(57) ABSTRACT

An image forming device which transfers a toner image carried on an image carrying body from the image carrying body to a transfer receiving body in a transfer section, the device including a charge producing section provided at an upstream side, in a moving direction of the transfer receiving body, with respect to a position at which the image carrying body and the transfer receiving body oppose each other so as not to be contacted with the transfer receiving body.

34 Claims, 20 Drawing Sheets

17
16
20
18

28
16
20
18

112
140
122
116

112
140
122

112
141
122

121
17
16
20
18
28
16
20
18

IMAGE RECORDING DEVICE HAVING A CHARGE PRODUCING SECTION UPSTREAM OF A TRANSFER RECEIVING BODY

CROSS-REFERENCE TO RELATED APPLICATION

This application claims priority under 35 USC 119 from Japanese Patent Application Nos. 2005-238824 and 2005-238825, the disclosures of which are incorporated by reference herein.

BACKGROUND OF THE INVENTION

1. Field of the Invention

The present invention relates to an image recording device, especially relates to the image recording device in which a toner image is transferred and fixed on the paper.

2. Description of the Related Art

Conventionally, in an image recording device carrying out image exposure on a charged photoreceptor surface to form a toner image, the toner image is transferred on a transfer body such as paper or the like, and the image is fixed.

In the above mentioned image recording device, a toner is a charged powder, and the transfer body is charged by applying transfer voltage (transfer bias) having a polarity opposite to the toner, and the toner is transferred to the transfer body by electrostatically adsorbing the toner. However, especially in a case of a full color image, when plural kinds of toners are multiply transferred, a phenomenon in which the toners are scattered around the image (blur) often occurs. That is, toners transferred later around a toner image previously transferred are scattered, and then the scattered toners are observed as image blur. Even in the case of a monochrome image or single transfer, when a feeding speed of a transfer material becomes fast, a phenomenon in which toners are scattered around an image tends to be generated.

When the reason for blur is described with reference to an example using an intermediate transfer belt, two reasons can be considered, i.e., a reason such that in a transfer pre-nip section, a transfer electric field acts on an area in which a photo conductor and an intermediate transfer belt are not adhered, whereby the transfer electric field is bent toward a peripheral direction of the image by charge of toners previously transferred, and a reason such that after transferring a toner layer having predetermined charge to the intermediate transfer belt electrostatically and during when the toner layer is moved to a second transfer point, charge supplied from a primary transfer roller is damped from the intermediate transfer belt, whereby holding capability with respect to the toner is decreased so that the toner is scattered by a rebound of charges (of the same polarity) of the toner.

That is, as illustrated in FIG. 12A, when the toner 140 is transferred to the paper 122 which is fed in a white arrow direction, originally, the toner should be transferred as illustrated in FIG. 12B, however, as illustrated in FIG. 12C, the toner 140 flows backward in a feeding direction (the right side of FIG. 12C). Then a picture quality is deteriorated due to the toner 140 that has flowed backward on the paper 122 as the blur 141.

To restrict scattering (blur) of the toner such as described above, a transfer device having a conductive member in a space formed at an upstream side and/or a downstream side in an image carrying body moving direction near a transfer position and between an image carrying body and a rotating body for transfer is proposed (see for example, Japanese Patent Application Laid-Open (JP-A) No. 02-163779).

In the above-mentioned technique, scattering of the toner can be suppressed by applying voltage to a leading end portion of a transfer guide. However, there is a problem concerning the technique in that when voltage is applied to a chute member 14, in a case where resistance is lowered by water which is included in the paper, a transfer bias applied to a transfer section 18 escapes through the paper, resulting in a poor transfer (poor transferring effect).

Further, an image recording device which includes a sheet-shaped flexible member to which bias is applied before transfer and controls the voltage is suggested (see, for example JP-A No. 11-338276). However, in the device, bias is applied to prevent contamination of the transfer chute, and an effect of preventing toner from scattering is not mentioned.

SUMMARY OF THE INVENTION

The present invention has been made in view of the above circumstances and provides an image recording device that is superior in image quality and sufficiently suppresses scattering of toner.

A first aspect of the invention provides an image forming device which transfers a toner image carried on an image carrying body from the image carrying body to a transfer receiving body in a transfer section, the device including a charge producing section provided at an upstream side, in a moving direction of the transfer receiving body, with respect to a position at which the image carrying body and the transfer receiving body oppose each other so as not to be contacted with the transfer receiving body.

In the invention of the above-mentioned constitution, blur, namely scattering of toner to a rear portion of an image can be suppressed by an antistatic effect of the charge producing section.

A second aspect of the invention provides an image forming device which transfers a toner image carried on an image carrying body from the image carrying body to a transfer receiving body at a transfer section, wherein a self-discharge type antistatic member is provided so as not to be contacted with the transfer receiving body at an upstream side, in a moving direction of the transfer receiving body, with respect to a position at which the image carrying body and the transfer receiving body oppose each other.

In the invention of the above-mentioned constitution, blur, namely scattering of toner to a rear portion of the image can be suppressed by an antistatic effect of the antistatic member.

The invention is constituted as described above, and therefore, an image recording device that is superior in image quality and sufficiently suppresses scattering of toner can be provided.

BRIEF DESCRIPTION OF THE DRAWINGS

Preferred embodiments of the present invention will be described in detail based on the following figures, wherein.

DETAILED DESCRIPTION OF THE INVENTION

Device Configuration

Figure 1:
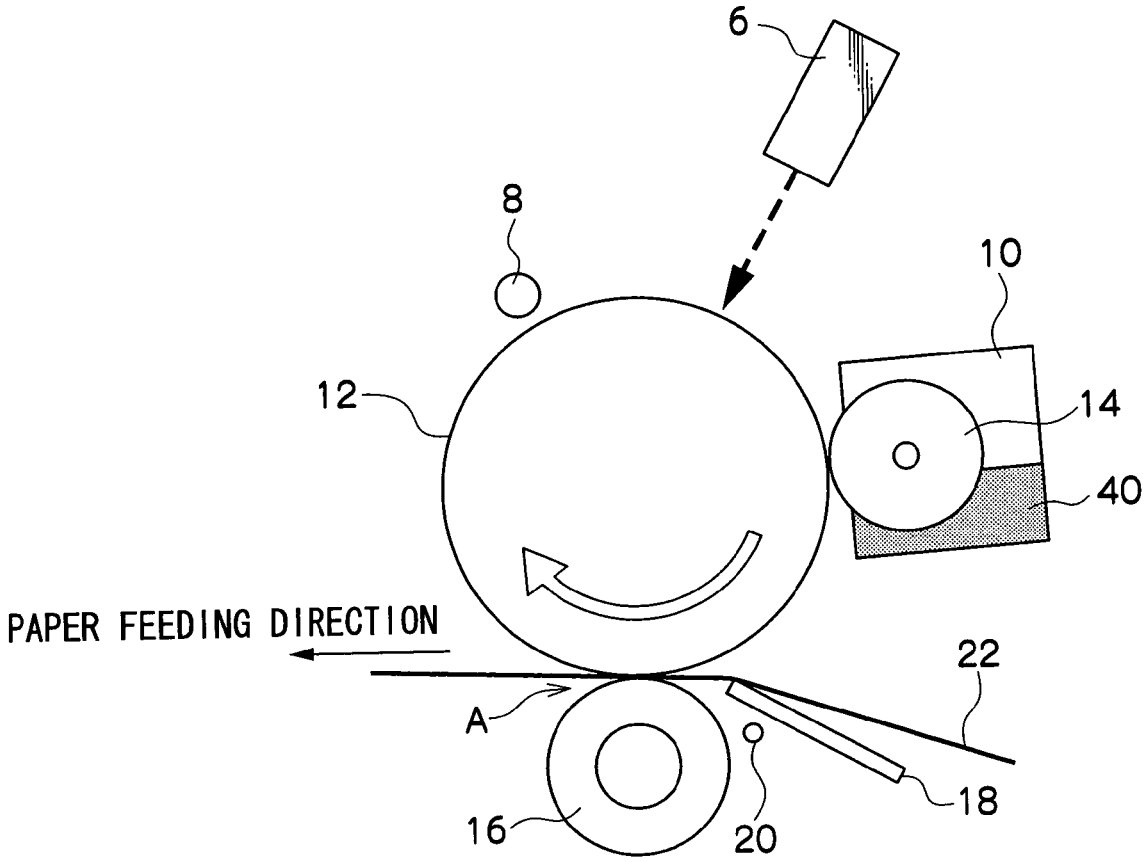
FIG. 1 is a drawing illustrating a transfer section of the image forming device according to a first embodiment of the invention.
Figure 2:
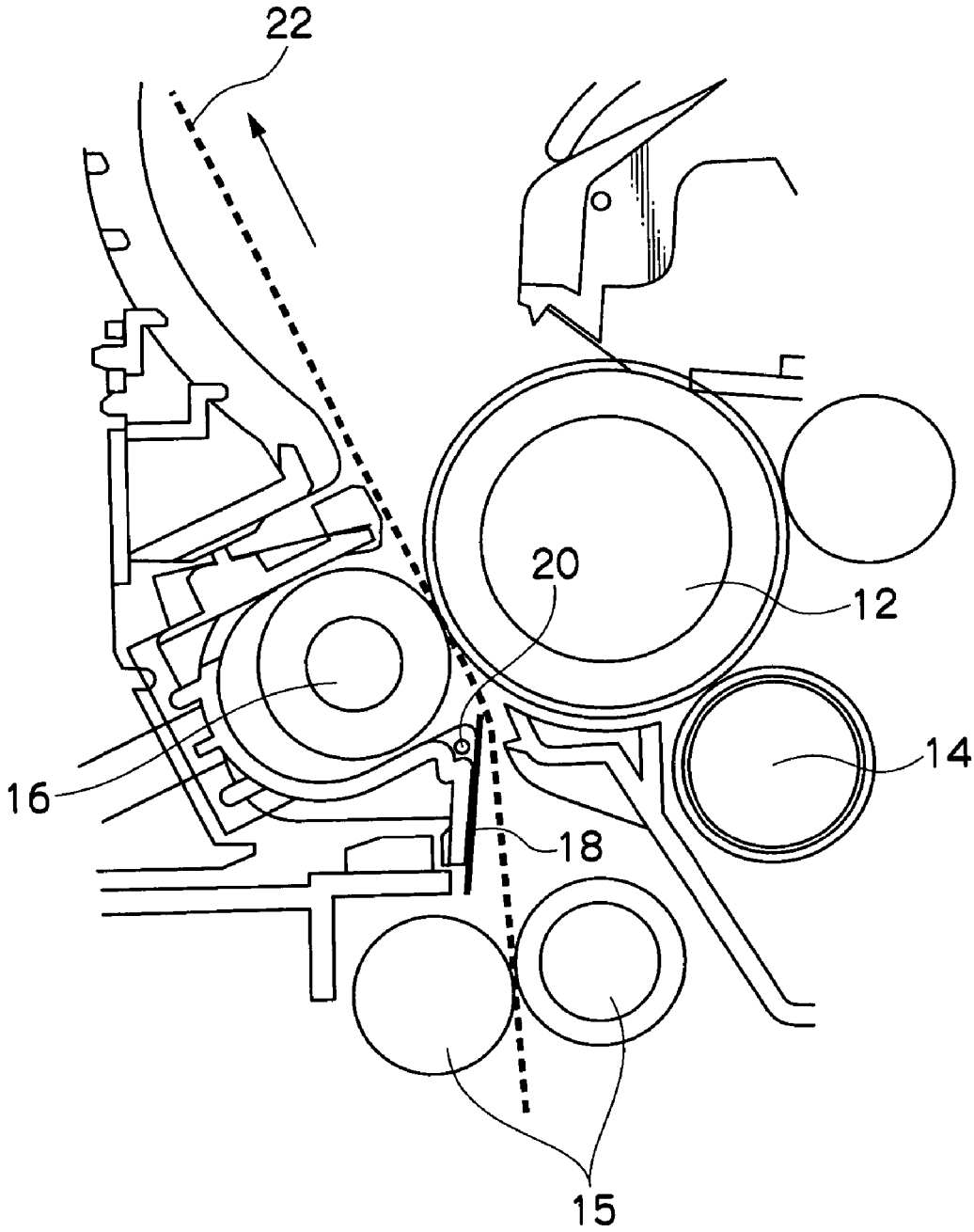
FIG. 2 is a drawing illustrating a transfer section of the image forming device according to the first embodiment of the invention.
Figures 3A, 3B:
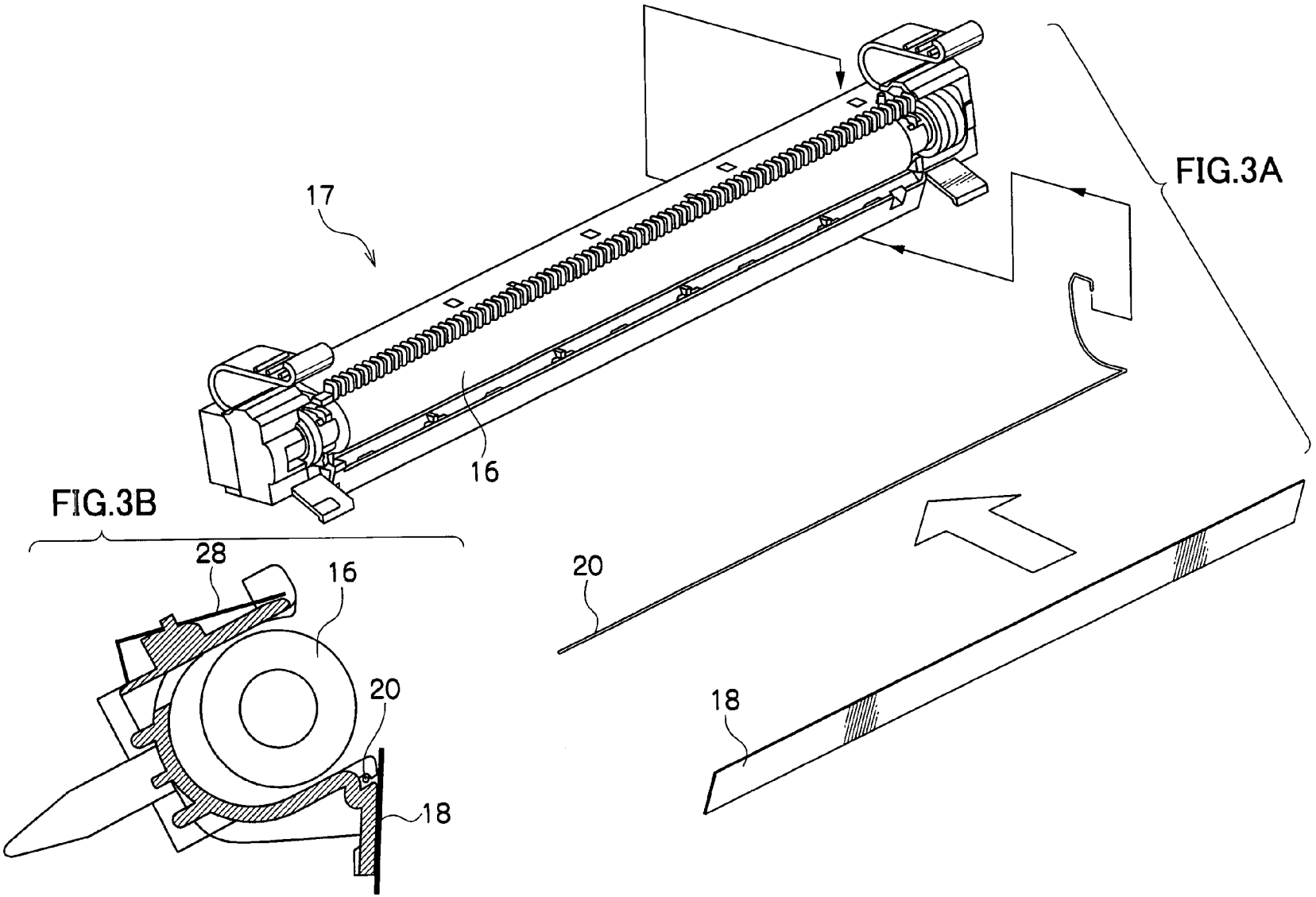
FIG. 3 is a perspective view illustrating a transfer section of the image forming device according to the first embodiment of the invention.

In FIGS. 1 to 3, a transfer unit of the image forming device according to a first embodiment of the present invention is illustrated.

As shown in FIG. 1, a surface of a photoconductor drum 12 is charged in a charger 8, and image exposure is carried out by a ROS 6. An electrostatic latent image provided by the exposure is developed as a toner image with a developing roller 14 of a developer 10. A toner image formed on the photoconductor drum 12 is nipped between the transfer roller 16 and the photoconductor drum 12, and transferred to paper 22 which is to be fed.

Then, voltage having a polarity that is the same as that of the toners is applied to a PTB (Pre Transfer Bias) wire 20, i.e., the charge producing section installed so as not to be contacted with the paper 22. Thereby, an electric field of a direction from the PTB wire 20 to the transfer nip portion A is formed on the toner transferred from a surface of the photoconductor drum 12 to the paper 22. Since there is no shielding matter obstructing the electric field between the PTB wire 20 and the transfer nip portion A, the electric field generated on the PTB wire 20 directly reaches the transfer nip portion A.

Thereby, since an electromagnetic force is applied in a direction of which the toner scattered to an upstream direction is pushed back by the above mentioned electric field having a polarity that is the same as that of the toners, scattering (blur) of the toner to a backward, i.e., a feeding direction upstream of the toner image is suppressed.

Further, the PTB wire 20 is provided so as not to be contacted with the paper 22. Thereby, even when resistance is lowered by water which is included in the paper 22, a problem such that a transfer bias applied to a transfer roller 16 escapes through the paper 22 resulting in a poor transfer can be prevented without charging the paper 22 itself.

Especially, the problem of poor transfer generated by a transfer bias applied to the transfer roller 16 from the PTB wire 20 escaping through the paper 22 can be prevented in a high temperature/high humidity environment which may lower resistance of the paper 22.

Moreover, in this case, the shielding member 18 is provided between the paper 22 and the PTB wire 20. This shielding member 18 is a member for forming a feeding path which guides the paper 22 so that the paper 22 and the PTB wire 20 are not contacted, and the shielding member 18 has flexibility. Therefore, if a thickness of the paper 22 is changed, even when thick paper is fed, for example, it does not interfere with feeding property.

Further, here, the PTB wire 20 comprises the linear conductive member, and as long as the PTB wire 20 is provided in parallel to the conveying surface of the paper 22, a simple configuration space saving can be realized. Downsizing of the whole device can also be realized.

An effect of blur reduction with above mentioned PTB wire 20 can be enhanced for example, by increasing bias voltage applied to the PTB wire 20 illustrated in FIG. 2 or, opening or un-shielding a nip direction of the photoconductor drum 12 and the transfer roller 16.

Further, a hard member is desirable as the shielding member 18, as long as no problem concerning a feeding performance is generated. If a soft member is used, when feeding the thick paper, the shielding member 18 is bent in the transfer roller 16 side, and the paper is entered from the transfer roller side, then transfer is started in a pre-nip section, thereby blur is rather worsened. When the soft member is employed, it is desirable to shorten F/L (free length) in a range that a feeding property of the thick paper is not interrupted as described later.

Furthermore, when resistance is lowered due to inclusion of water in the paper 22 as mentioned above, it is effective to prevent so-called hydrous paper poor transfer phenomenon by making the paper 22 and the PTB wire 20 non-contact (separating between the paper 22 and the PTB wire 20), or by insulating the shielding member 18.

Further, generation of blur can be suppressed by applying voltage having a polarity that is the same as that of the toner to the PTB wire 20 as described above. However, application of voltage to the self-discharge type antistatic member 20 is not necessarily required. For example, the antistatic member in which a ground is established also has a blur suppressing effect.

The transfer unit of the image forming device according to the first embodiment of the invention is illustrated in FIG. 3.

As shown in FIG. 3, the PTB wire 20 is provided on a feeding direction upstream side of the transfer unit 17 holding the transfer roller 16 in parallel with the conveying surface, and the shielding member 18 is provided between the conveying surface and the PTB wire 20 so that the paper 22 is not contacted with the PTB wire 20. Further, a non-contacting relation between the PTB wire 20 and the transfer roller 16 is maintained.

Figure 9:
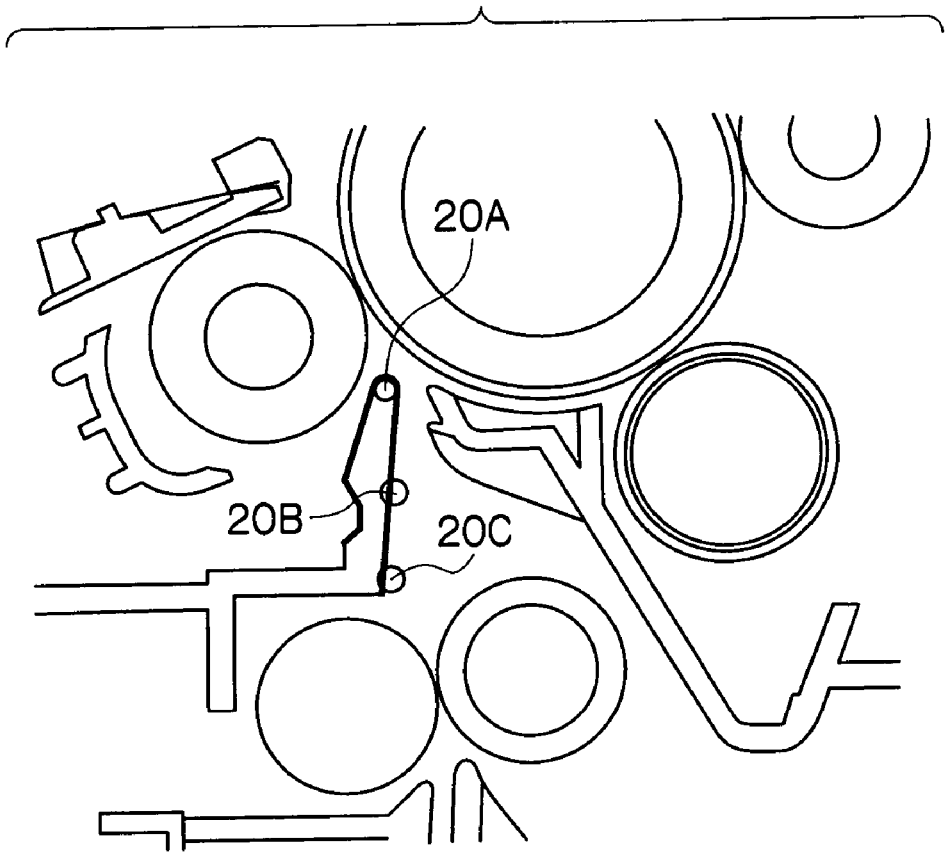
FIG. 9 is a drawing illustrating a position of a charge producing section of an image forming device according to the invention.

Then, as shown in FIG. 9, when a position of the PTB wire 20 is changed from 20A to 20C, blur preventing effect is high only at a position of 20A near the transfer roller 16, and the blur preventing effect at 20B and 20C is low. Therefore, in the invention, the PTB wire 20 is positioned in a neighborhood of the transfer roller 16. The PTB wire 20 as a voltage applying member does not require a large surface area, and a wire-shape may be used as is in the present embodiment.

Furthermore, in the present embodiment, a separate voltage supplying section for the PTB wire 20 is not necessary, and only voltage supplied to an antistatic member 28 (DTS) described below is utilized, and, a transfer unit 17 is formed by uniting the antistatic section 28, the transfer roller 16, the PTB wire 20 and the shielding member 18. Thereby, enhancement of assembling characteristics, decreasing of the number of parts, and cost reduction can be realized.

Figure 10:
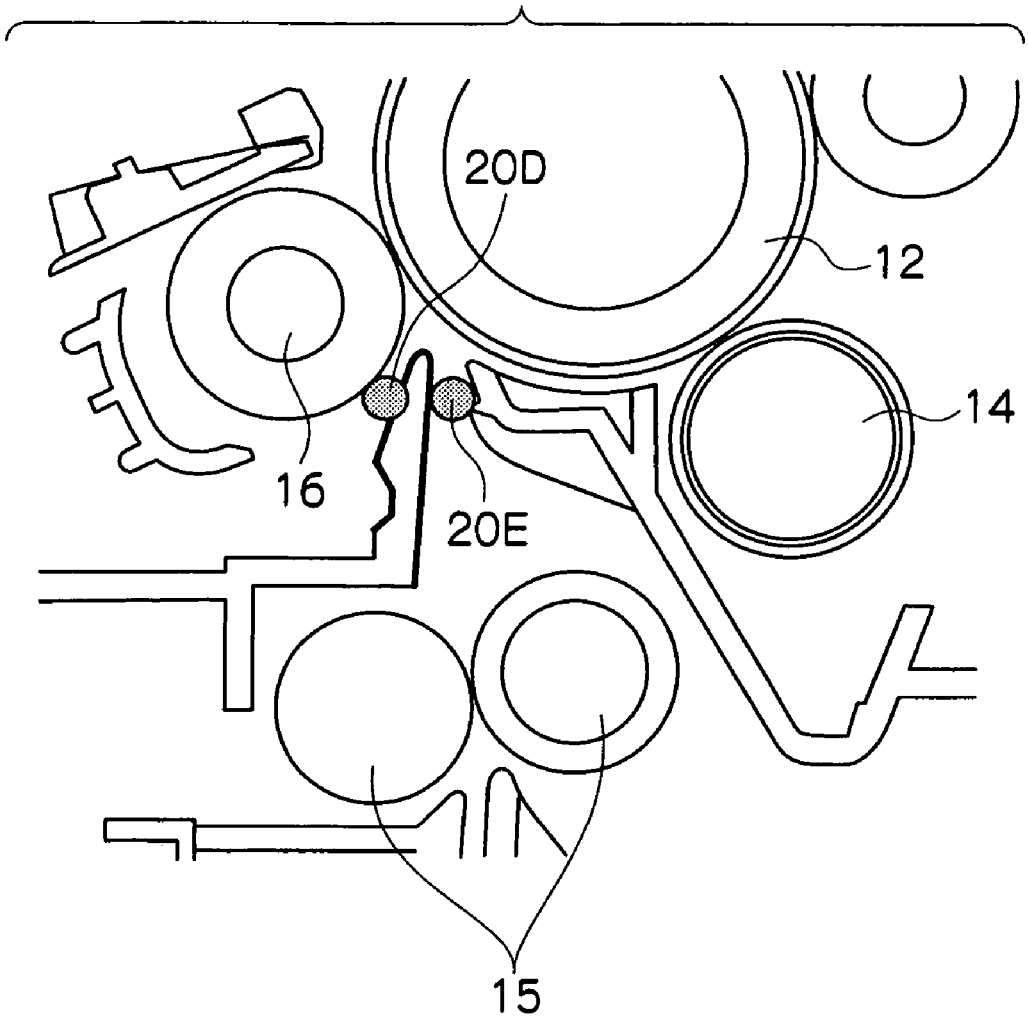
FIG. 10 is a drawing illustrating the position of the charge producing section of the image forming device according to the invention.

Furthermore, as shown in FIG. 10, when the PTB wire 20 is disposed at a closest of the paper 22, that is, 20E near the conveying surface, a transfer electric field cannot be held on a paper in which water is included in high-temperature and high humidity conditions, and resulted in poor transfer. When the PTB wire 20 is separated and arranged from the paper conveying surface as shown by 20D, a hydrous paper poor transfer can be avoided. When an electric current is flown to the PTB wire 20 (when a transfer electric field cannot be hold) poor transfer can be avoided by taking distance between the PTB wire 20 and the conveying surface as well as descending voltage applied to the PTB wire 20 as described later.

Further, by constituting the PTB wire 20 so that a length of the PTB wire 20 is shorter than that of the transfer roller 16 and the PTB wire 20 is not adjacent to the both ends of the transfer roller 16, a large creeping distance between the PTB wire 20 and the conductive member such as an end bearing of the transfer roller 16 can be secured.

Thereby, generation of leak or the like between the PTB wire 20 and the conductive member such as the end bearing of the transfer roller 16 can be suppressed.

A Principle of a Countermeasure to Blur

The charge producing section of the image forming device according to the first embodiment of the invention is shown in FIG. 4.

As shown in FIG. 4, the paper 22 is nipped between the photoconductor drum 12 and the transfer roller 16. Then, after the toner 40 (a toner image) formed on the surface of the photoconductor drum 12 is transferred on the paper 22, the toner is fixed by a fixing device (not shown) as a toner image.

Figures 12A, 12B, 12C:
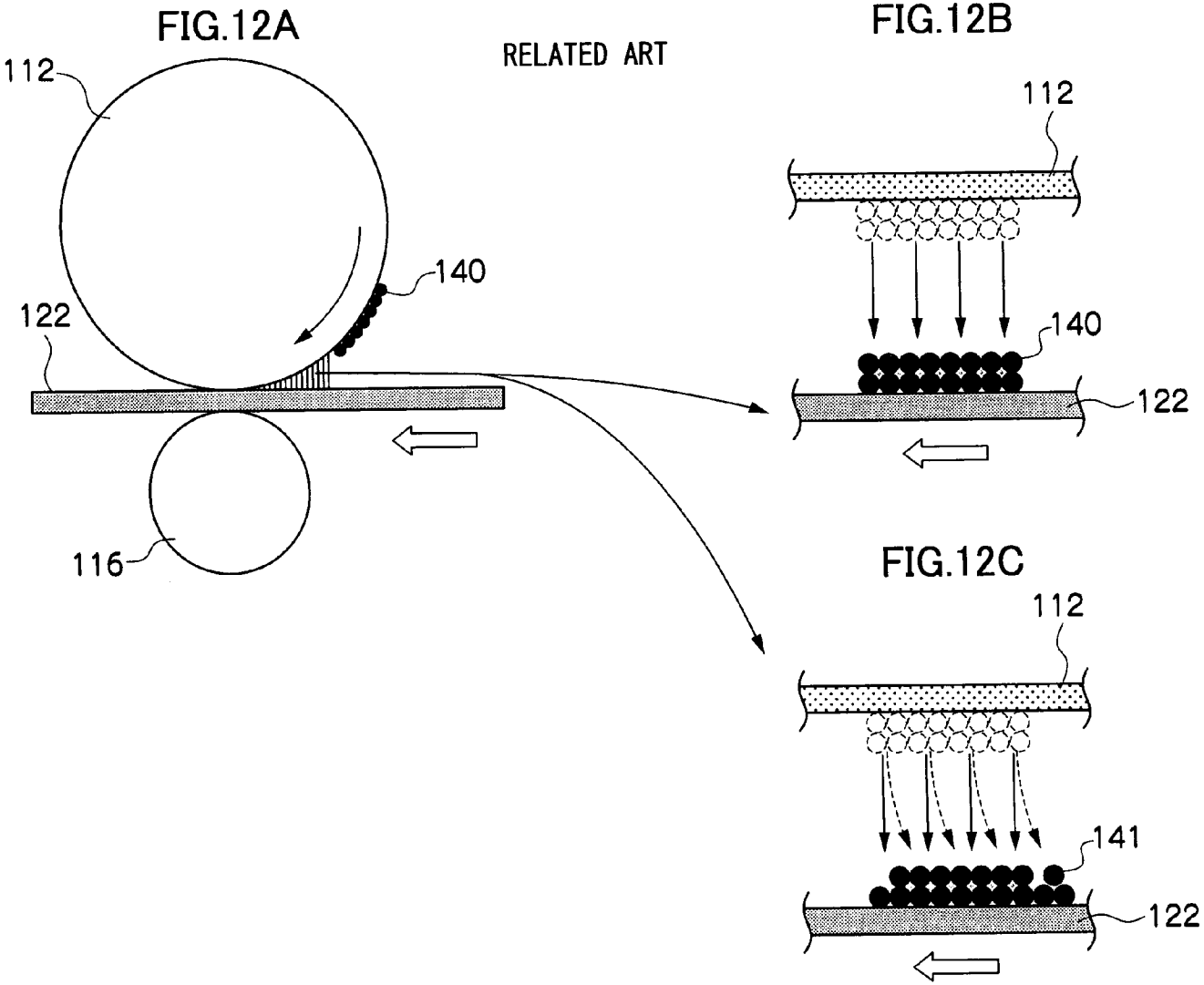
FIG.12A RELATED ART
FIG. 12 is side-view illustrating a transfer section of a conventional image forming device.

Then, as described above, voltage having polarity opposite to that of the toner 40 is applied to the paper 22, and the toner 40 is absorbed electrically. However, in fact, especially when a transporting velocity of the paper 22 is high, the toner 40 flows to a feeding direction upstream side as illustrated in FIG. 12C. As a result, the toner 40 transferred to the position slipped off behind an image remains as blur, and accordingly, a picture quality is degraded.

Figure 4A:
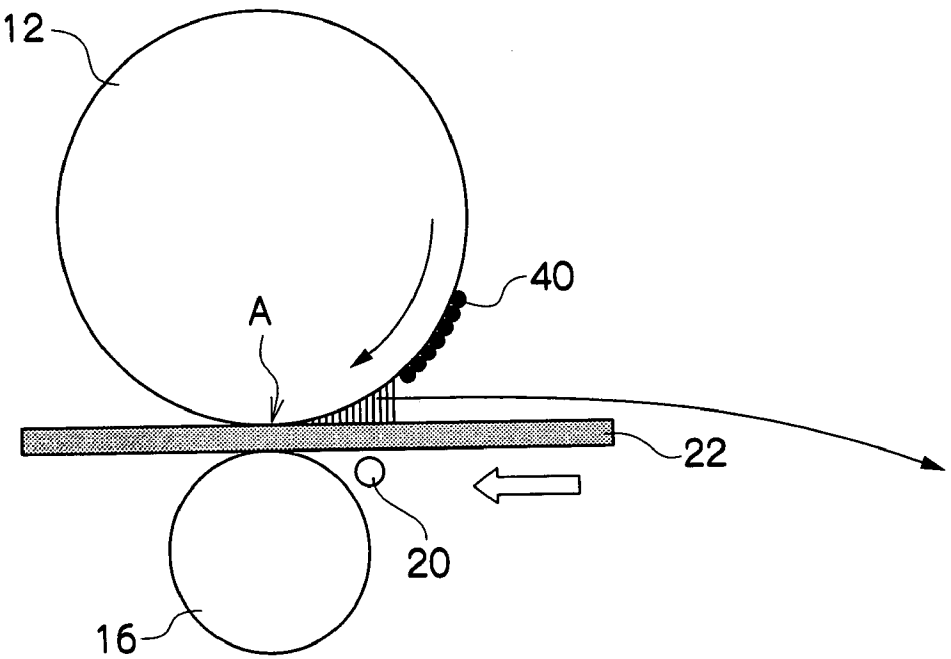
FIG. 4 is a drawing illustrating a blur preventing mechanism of the image forming device according to the first embodiment of the invention.
Figure 4B:
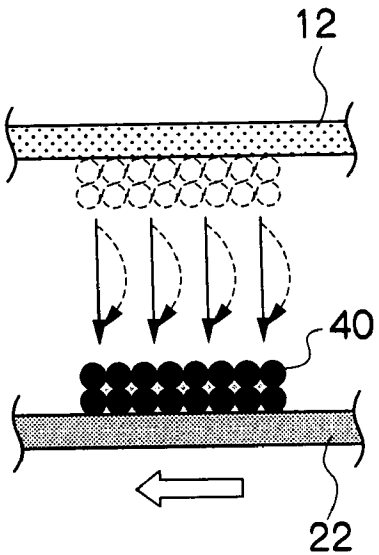

Thus, in the invention, as illustrated in FIG. 4A, the PTB wire 20 which is the charge producing section is provided near a back surface of the paper 22 at a feeding direction upstream side from a nip position A of the paper 22, and by applying voltage having a polarity that is the same as that of the toner 40, an electric field directed from the PTB wire 20 to the transfer nip portion A is formed and repels the toner 40 electrically. Therefore, blur can be prevented by pushing back the toner 40, which would flow to a feeding direction upstream side (right side of the drawing) (the reason for blur), to a feeding direction downstream side (a left side of the drawing) as illustrated in FIG. 4B (by a dotted arrow), and thereby transferring the toner at the correct position.

Other Embodiments

Figure 5:
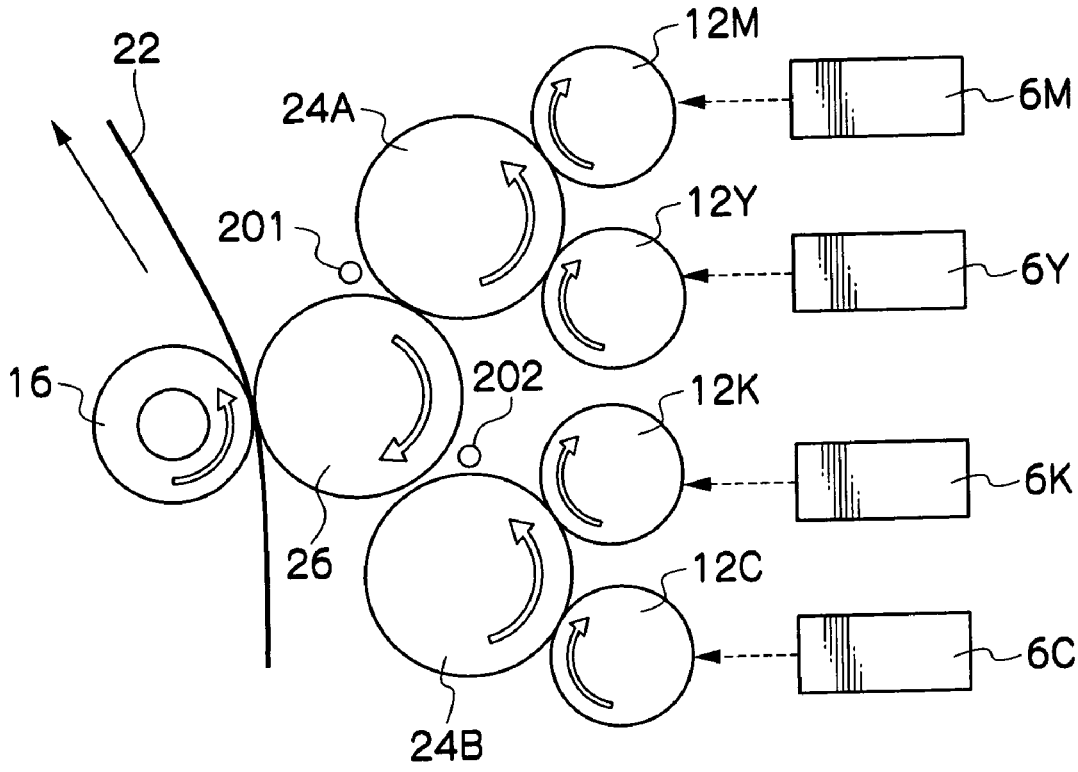
FIG. 5 is a drawing illustrating a transfer section of the image forming device according to a second embodiment of the invention.

The transfer unit of the image forming device according to the second embodiment of the invention is illustrated in FIG. 5.

As shown in FIG. 5, the image forming device according to the present embodiment comprises the photoconductor drums 12Y to 12K corresponding to YMCK four colors so as to print in multi-colors and image exposure is carried out by ROS 6Y to 6K to expose light to the respective photoconductor drums 12.

The exposed photoconductor drums 12Y to 12K are respectively supplied with the toners in a developer (not shown), and an electrostatic latent image is developed. The developed toner image is transferred to the first intermediate transfer roller 24A, 24B by two colors. Furthermore, two colored images on the first intermediate transfer rollers 24A, 24B are transferred to the second intermediate transfer roller 26 and result in a four-colored image. Then the four-colored image is transferred to the paper 22 nipped between the transfer roller 16 and the second intermediate transfer roller 26 to form a final image.

Then, as illustrated in FIG. 5, the PTB wire 201 is provided between the first intermediate transfer rollers 24A and the second intermediate transfer roller 26 at a rotational direction upstream side from a contact position. An electric field directed toward a rotational direction downstream side (right bottom of the drawing) of the first intermediate transfer rollers 24A and the second intermediate transfer roller 26 is formed and repels the toner electrically. Therefore, blur when a two colored image is transferred from the first intermediate transfer rollers 24A to the second intermediate transfer rollers 26 can be prevented by pushing back the toner, which would flow to a rotational direction upstream side (left upper of the drawing), to a rotational direction downstream side and thereby transferring the toner at the correct position.

Similarly, the PTB wire 202 is provided between the first intermediate transfer rollers 24B and the second intermediate transfer roller 26 at a rotational direction upstream side from a contact position. An electric field directed toward a rotational direction downstream side (left bottom of the drawing) of the first intermediate transfer rollers 24B and the second intermediate transfer roller 26 is formed and repels the toner electrically. Therefore, blur when a two colored image is transferred from the first intermediate transfer rollers 24B to the second intermediate transfer rollers 26 can be prevented by pushing back the toner, which would flow to a rotational direction upstream side (right upper of the drawing), to a rotational direction downstream side and thereby transferring the toner at the correct position.

The PTB wire 20 may be provided in order to prevent blur which may occur during transferring between the intermediate transfer rollers, rather than to prevent blur which may occur in the transferring section transferring from the intermediate transfer rollers to the paper 22. Further, the PTB wire 20 may be provided in order to prevent blur during transferring from the second intermediate transfer rollers 26 to the paper 22.

Figure 6:
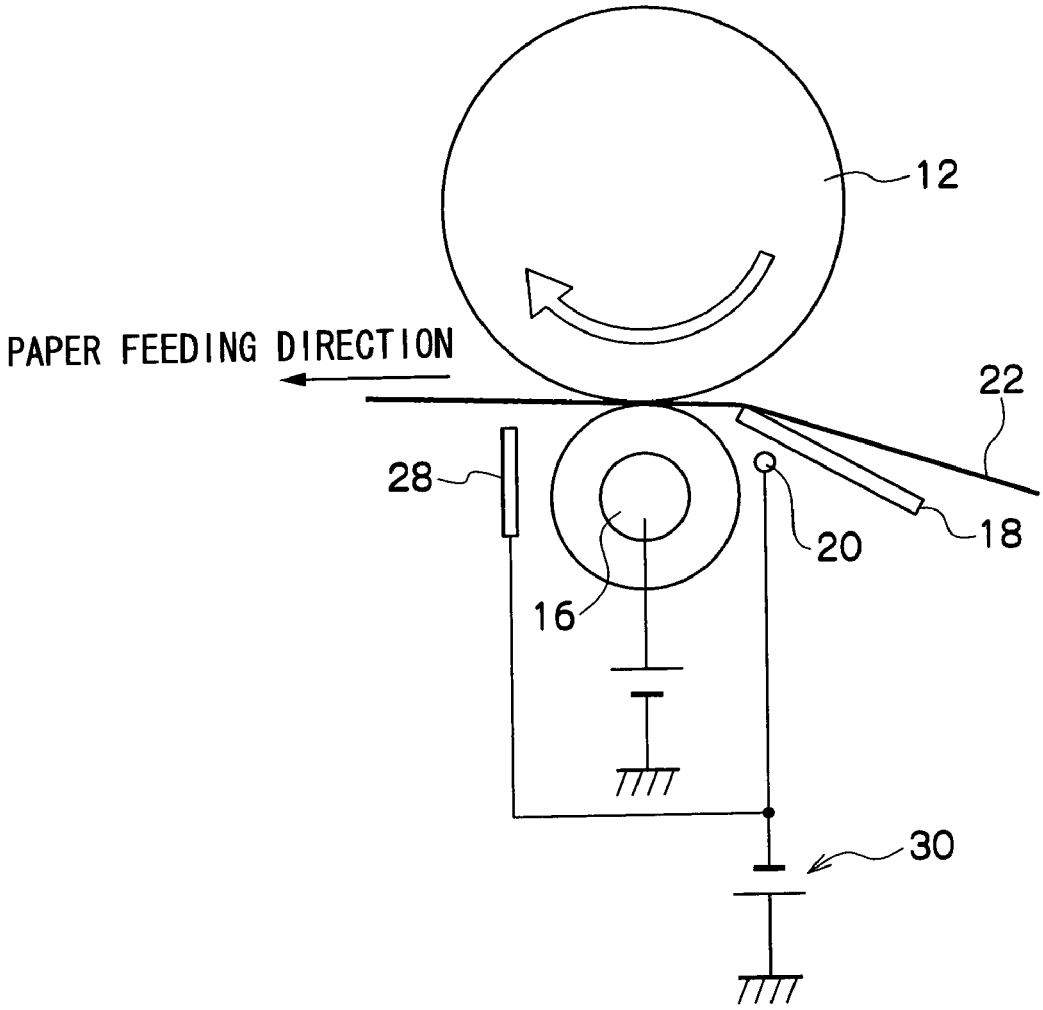
FIG. 6 is a drawing illustrating a transfer section of the image forming device according to a third embodiment of the invention.

The transfer unit of the image forming device according to the third embodiment of the invention is illustrated in FIG. 6.

As shown in FIG. 6, the transfer unit of the image forming device according to the present embodiment comprises an antistatic member 28 (DTS) at a feeding direction downstream side of the transfer roller 16 so as not to be contacted with the paper 22, and voltage is applied to the paper 22 after when the toner image is transferred, then peeling of the paper 22 from the transfer roller 16 is assisted.

In this case, since voltage applied to the paper 22 by the antistatic member 28 (DTS) may have a polarity that is the same as that of voltage applied to the PTB wire 20, as illustrated in FIG. 6, a power source which applies voltage to the PTB wire 20 and a power source which applies voltage to the antistatic member 28 can be used in common as a power source 30.

Figure 7:
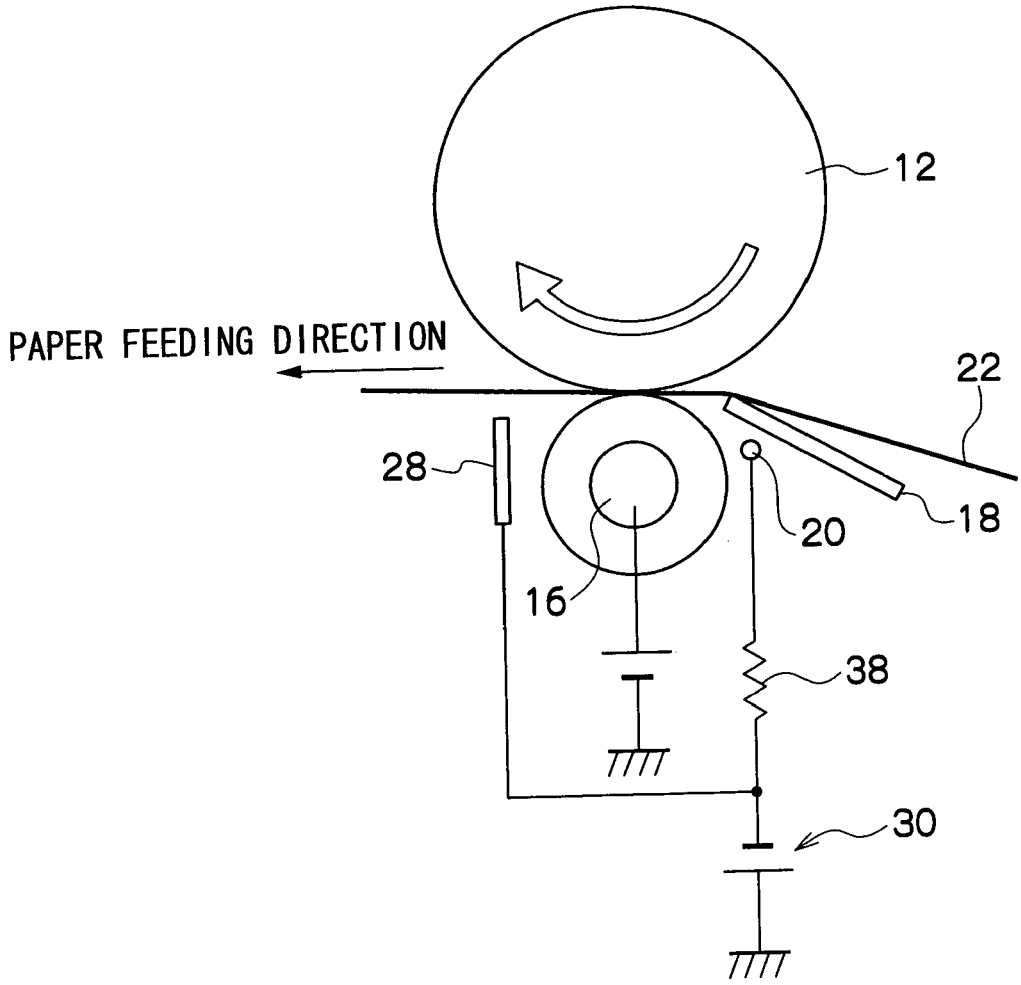
FIG. 7 is a drawing illustrating a transfer section of the image forming device according to a fourth embodiment of the invention.

The transfer unit of the image forming device according to the fourth embodiment of the invention is illustrated in FIG. 7.

As shown in FIG. 7, the transfer unit of the image forming device according to the present embodiment similarly comprises an antistatic member 28 (DTS) at a feeding direction downstream side of the transfer roller 16 so as not to contact with the paper 22, and voltage is applied to the paper 22 after when the toner image is transferred, then peeling of the paper 22 from the transfer roller 16 is assisted and a power source which applies voltage to the PTB wire 20 and a power source which applies voltage to the antistatic member 28 can be used in common as a power source 30.

In the present embodiment, when voltage is applied to the PTB wire 20 from the power source 30, resistance 38 is inserted on the way, because, if an transfer electric current leaks (an electric current flows to the PTB wire 20 from the paper 22 side) in a high temperature/high humidity environment, it is necessary to control the flowing electric current by dropping a voltage. That is, with a paper in which water is included in high humidity, the transfer electric current leaks, therefore, an electric field for transfer cannot be held and resulted in poor transfer. Therefore, the resistance 38 is inserted between the PTB wire 20 and the power source 30, so that voltage drops when an electric current flows. On the other hand, in a cold temperature/low humidity environment, a quantity of an electric current flowing to the PTB wire 20 is small and an influences of voltage drop is also small, therefore, high voltage can be applied to the antistatic member 28 and the PTB wire 20. Further, the transfer unit of the image forming device according to the present embodiment can be configured so that no power source is supplied to the antistatic member 28.

Figure 8:
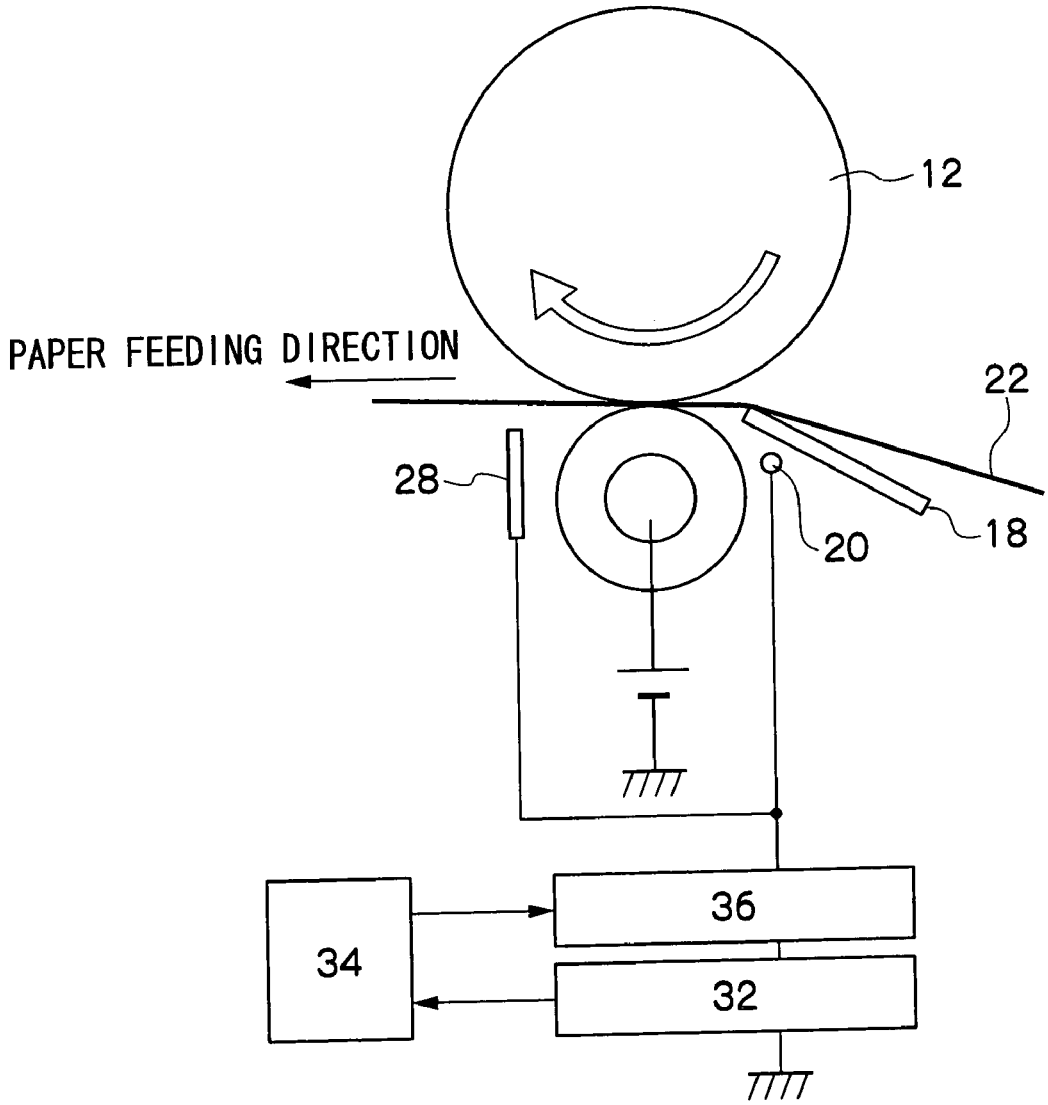
FIG. 8 is a drawing illustrating a transfer section of the image forming device according to a fifth embodiment of the invention.

The transfer unit of the image forming device according to the fifth embodiment of the invention is illustrated in FIG. 8.

As shown in FIG. 8, the transfer unit of the image forming device according to the present embodiment similarly comprises an antistatic member 28 (DTS) at a feeding direction downstream side of the transfer roller 16 so as not to contact with the paper 22, and voltage is applied to the paper 22 after when the toner image is transferred, then peeling of the paper 22 from the transfer roller 16 is assisted and a power source which applies voltage to the PTB wire 20 and a power source which applies voltage to the antistatic member 28 can be used in common.

In the present embodiment, a voltage generating section 36 is provided instead of the power source 30. And an electric current sensor section 32 for monitoring an electric current that flows to the antistatic member 28 and PTB wire 20, and a MCU34 controlling the voltage generating section 36 depending on a value of an electric current detected in an electric current sensor section 32 and adjusting voltage applied to the PTB wire 20 and the antistatic member 28 are also provided.

When an electric current flowing in the antistatic member 28 and PTB wire 20, which is detected in the electric current sensor section 32, is over a predetermined threshold (for example, 10 μA), it is indicated that the transfer electric current of the paper 22 leaks, that an electric field for transfer cannot be held, and that the transfer will therefore result in poor transfer, and the voltage generating section 36 is controlled so that voltage thereof is lowered. Thereby, generation of poor transfer caused by voltage applied to the PTB wire 20 can be prevented.

Further, the transfer unit of the image forming device according to the present embodiment may be configured so that voltage applied to the antistatic member 28 is always constant without control and only voltage applied to the PTB wire 20 is controlled in the MCU34 depending on an electric current detected in the electric current sensor section 32.

Processing Speed

Conventionally, there is a device in which plural processing/transporting speeds of the image forming device are set and the speeds are changed depending on an application and a condition such as the transferred material. The invention can also be applied to these image forming devices of processing speed variable type.

That is, if a processing speed is changed, accordingly generation condition of blur is also changed. Concretely, poor transfer tends to be generated by transportation at low speed, and on the other hand, blur tends to be generated by transportation at high speed. Therefore, an optimum value of the voltage applied to the charge producing section (the PTB wire 20) for preventing blur is also changed depending on a processing speed.

Therefore, if it is constituted so that the processing speed is changed in several phases, an optimum voltage may be set in advance for a selected processing speed and the paper 22 beforehand, and then switched among several phases automatically, or a table installed in a control system may be referred to.

If it is constituted so that the processing speed can be changed continuously, the processing speed set at a point or the optimum voltage may be manually or automatically selected from the table installed in the control system with respect to the paper 22, or, a speed sensor may be provided in the device, and voltage may be controlled for the detected feeding speed and the paper 22 in real time.

Paper Type

Generally, there is a device in which plural paper types/sizes used in the image forming device are set so as to change the paper 22 depending on an application and a condition such as the transferred material. The invention can also be applied to these image forming devices.

That is, if a type of the paper 22, that is, thickness, composition, surface finish or the like, is changed, naturally, a condition for generating blur is also changed. Therefore, an optimum value of voltage applied to the charge producing section (PTB wire 20) for preventing blur is also changed depending on the type of the paper 22.

Therefore, if it is constituted so that the type of the paper 22 can be changed among several types, the selected type of the paper 22 may be detected automatically or input by an operator manually to an optimum voltage in advance for the type of paper 22 and may be switched among several phases automatically, or a table installed in a control system may be referred to.

Environmental Condition

Generally, there is a device in which changes in internal/external environmental conditions of the image forming device or various characteristic values affected by the environmental conditions are detected, and various conditions such as temperature control and/or voltage control are changed depending on the change. The invention can also be applied to these image forming devices.

If temperature/humidity fluctuates, naturally, a condition for generating blur is also changed, and therefore, an optimum value of voltage applied to the charge producing section (PTB wire 20) for preventing blur is also changed depending on an environmental condition such as temperature/humidity.

Therefore, it can be constituted so that the environmental condition or the characteristic value (for example, water content of the paper 22) that fluctuates due to the environmental condition may be detected to set in advance an optimum voltage for the environmental condition or the characteristic value and switch among several phases automatically, or a table installed in a control system may be referred to.

Alternatively, optimum voltage may be manually or automatically selected from the table installed in the control system according to various processing conditions controlled depending on the environmental condition or the characteristic value that fluctuates due to the environmental condition.

Further, various kinds of condition parameters such as the above mentioned processing speed, temperature/humidity in a room where the device is installed, the type of paper 22 and water content can be appropriately selected and then added to voltage control depending on a degree of influence thereof.

Shielding Element

Figure 11:
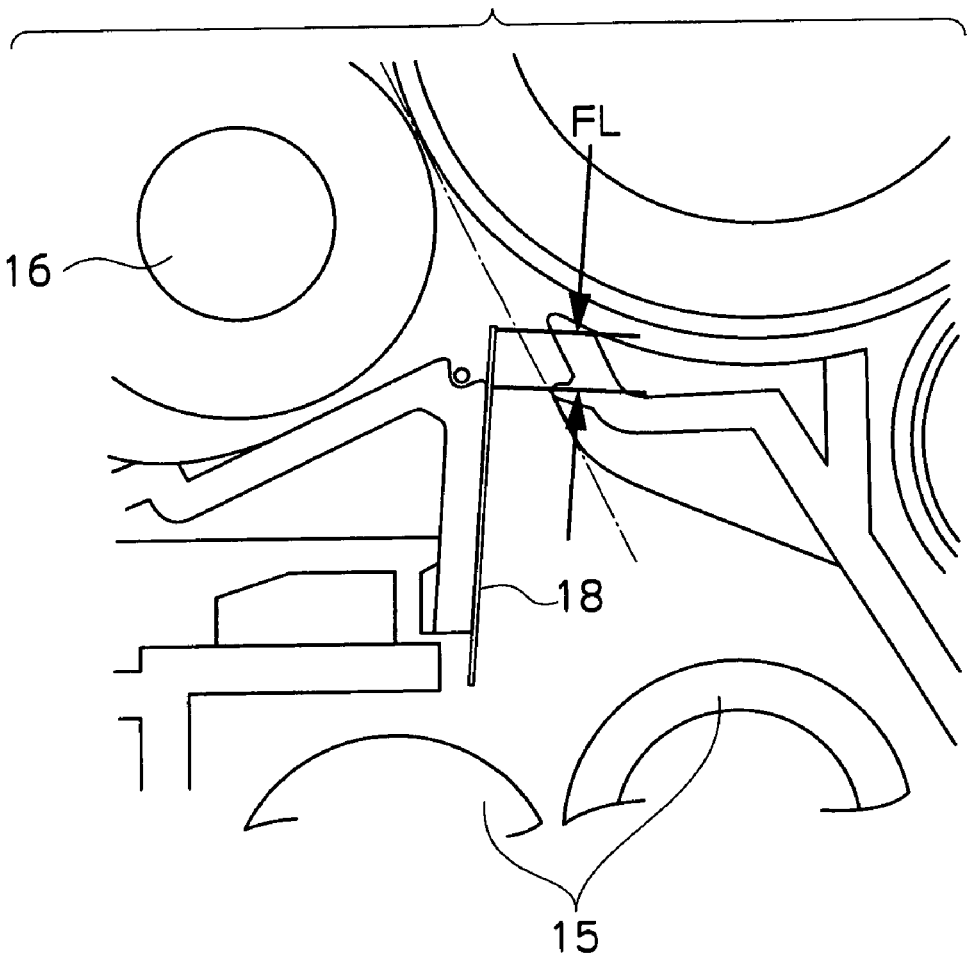
FIG. 11 is a drawing illustrating a shielding member of a transfer section of the image forming device according to the invention.

A transfer unit of an image forming device according to the invention is illustrated in FIG. 11.

As shown in FIG. 11, a free length (FL) is required to hold flexibility of the shielding member 11. However, for example, when a material such as PET is used, if the length FL is too long, when feeding the thick paper, the paper 22 enters into the transfer roller 16 with pushing and bending the shielding member 18. Accordingly, the paper enters from the transfer roller side and transfer in the Pre-nip section tends to be generated, therefore, the blur is rather worsened.

In this case, if there is a limit to shorten the Fl (around 1 mm) within a range that a transportation property of the thick paper when the PET is used for material, or shorten a united constitution constitutionally (that is, type constitution), when a soft member is used, it is desirable to shorten F/L (free length) in a range that a feeding property of the thick paper is not interrupted. A bend is reduced by increasing thickness of the PET of the shielding member 18, thereby the blur is prevented from being worsened when feeding the thick paper.

Other Modifications of the Invention

Figure 16A:
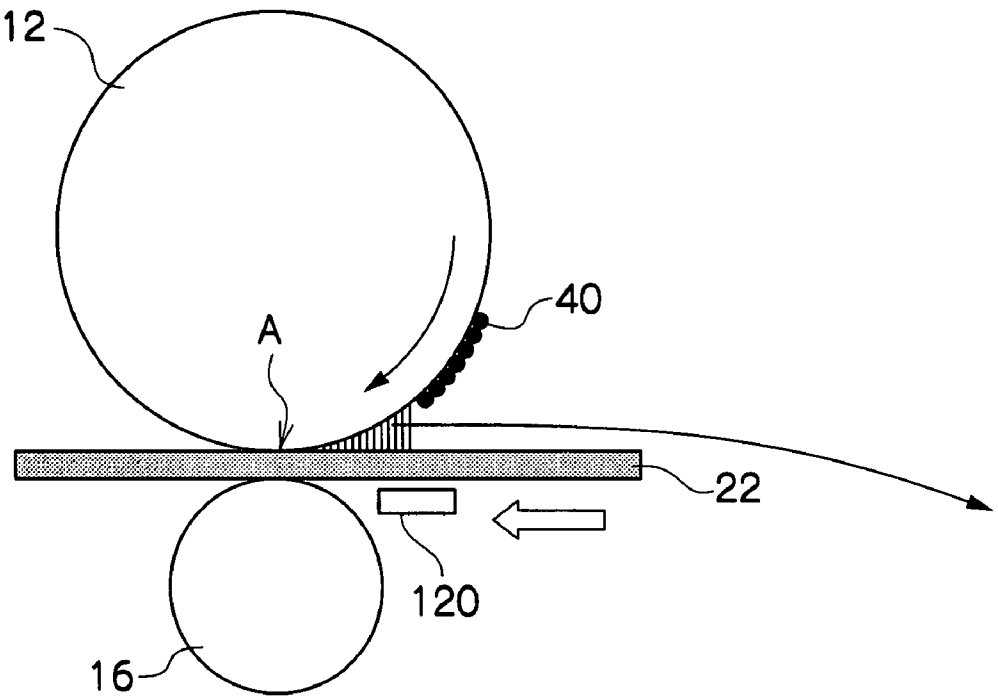
FIG. 16 is a drawing illustrating a blur preventing mechanism of the image recording device according to the sixth embodiment of the invention.
Figure 16B:
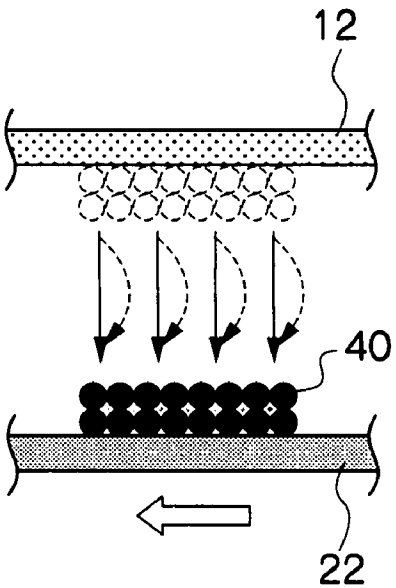
Figure 17:
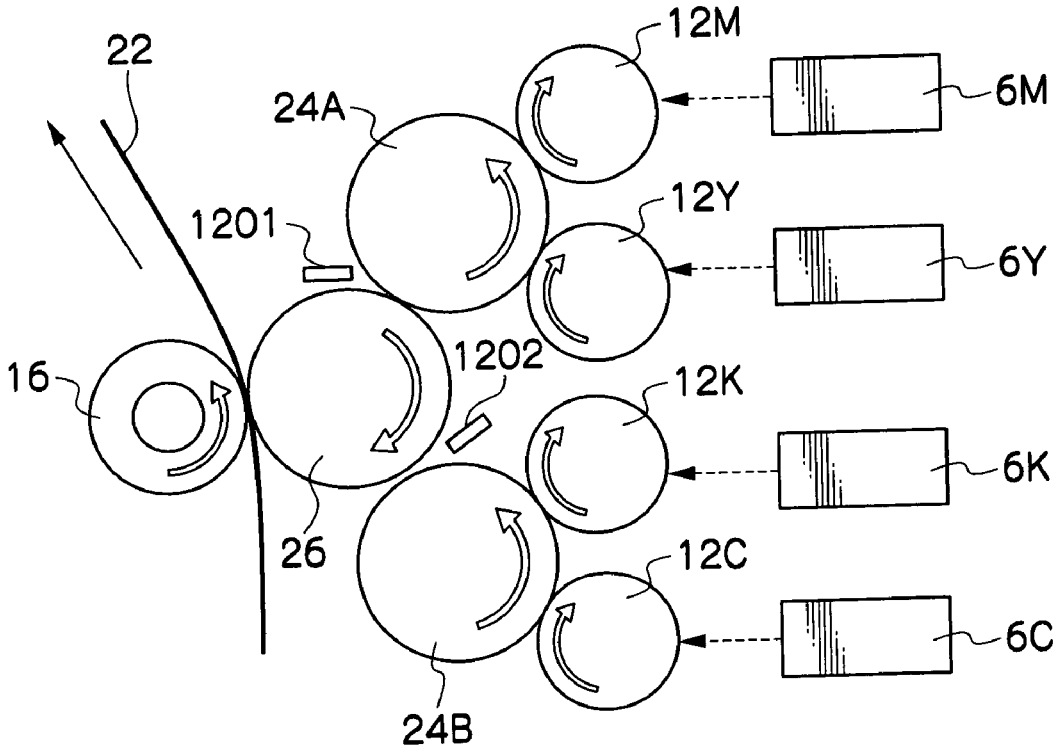
FIG. 17 is a drawing illustrating a transfer section of the image recording device according to a seventh embodiment of the invention.
Figure 18:
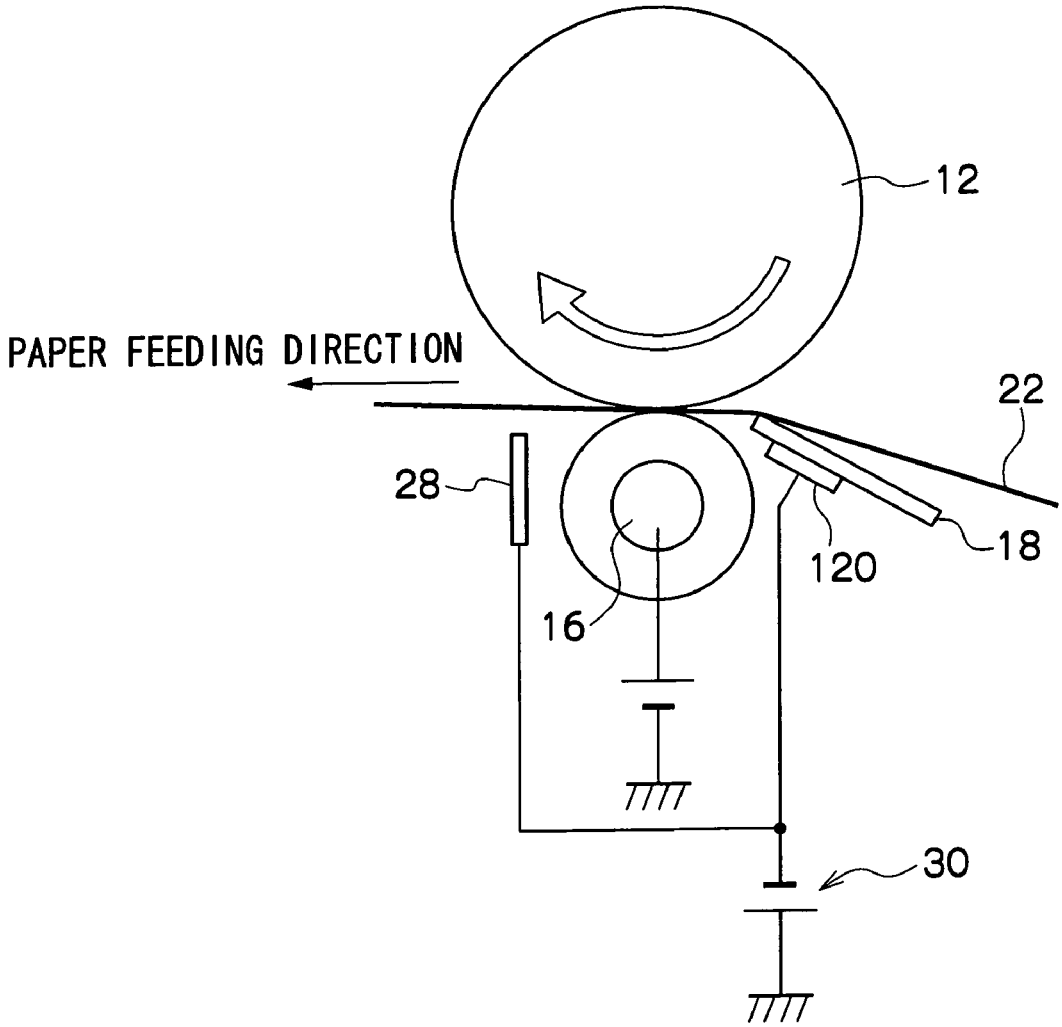
FIG. 18 is a drawing illustrating a transfer section of the image recording device according to an eighth embodiment of the invention.
Figure 19:
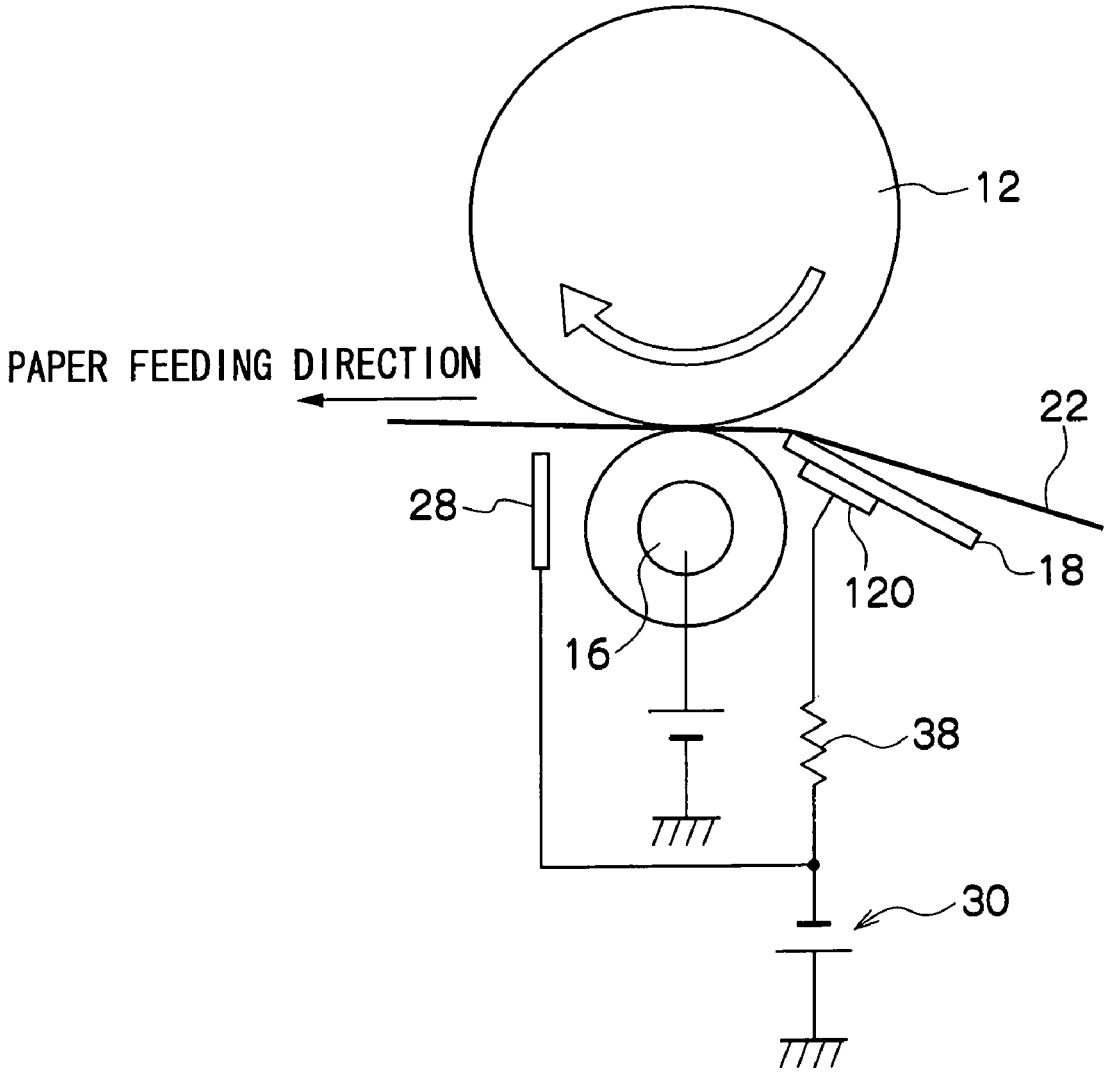
FIG. 19 is a drawing illustrating a transfer section of the image recording device according to a ninth embodiment of the invention.
Figure 20:
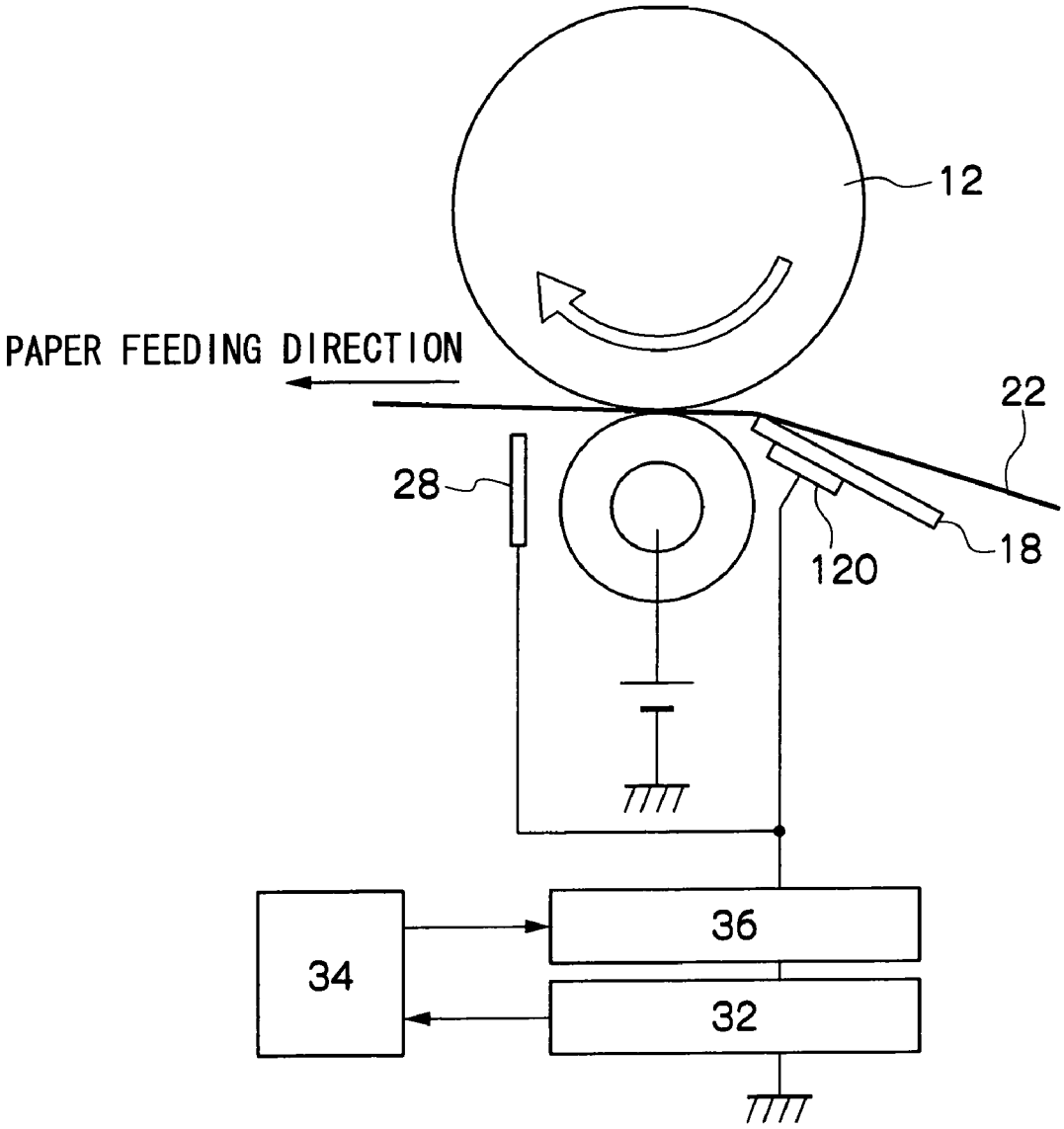
FIG. 20 is a drawing illustrating a transfer section of the image recording device according to a tenth embodiment of the invention.

In FIGS. 13 to 20, the sixth to tenth embodiments, i.e., modifications of the embodiment of the invention will be illustrated. Here, FIGS. 13 to 16 illustrate the sixth embodiment of the invention, and corresponds to the first embodiment shown in FIGS. 1 to 4. FIG. 17 illustrates the seventh embodiment of the invention, and corresponds to the second embodiment illustrated in FIG. 5. FIG. 18 illustrates the eighth embodiment of the invention, and corresponds to the third embodiment illustrated in FIG. 6. FIG. 19 illustrates the ninth embodiment of the invention, and corresponds to the fourth embodiment illustrated in FIG. 7. FIG. 20 illustrates an tenth embodiment according to the invention and corresponds to the fifth embodiment illustrated in FIG. 8.

Further, a main difference between the sixth to tenth embodiments and the first to fifth embodiments of the invention is that the self-discharge type antistatic member 120 is employed as the charge producing section without restricting to the wire-shaped PTB wire 20. Other constitutions and operations are as same as those of the first to fifth embodiments, therefore, the details will be omitted in the following description.

A transfer unit of the image recording device concerning the sixth embodiment of the invention is illustrated in FIGS. 13 to 16.

Figure 13:
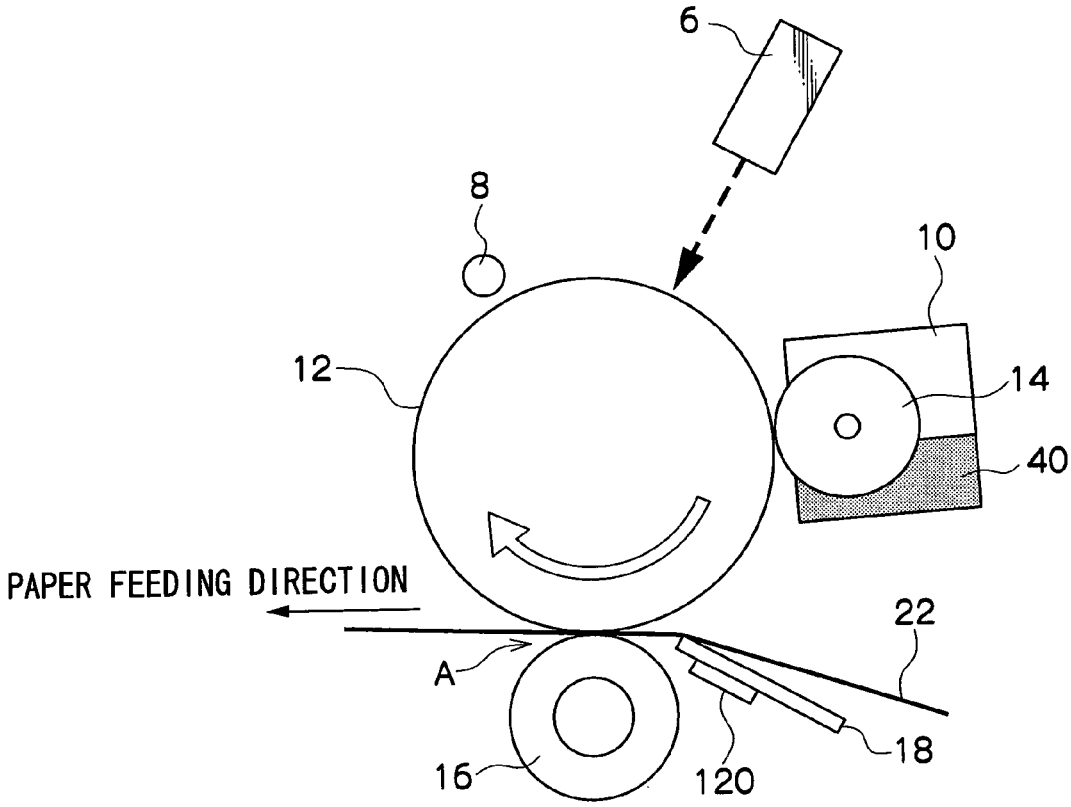
FIG. 13 is a drawing illustrating a transfer section of the image recording device according to a sixth embodiment of the invention.
Figure 14:
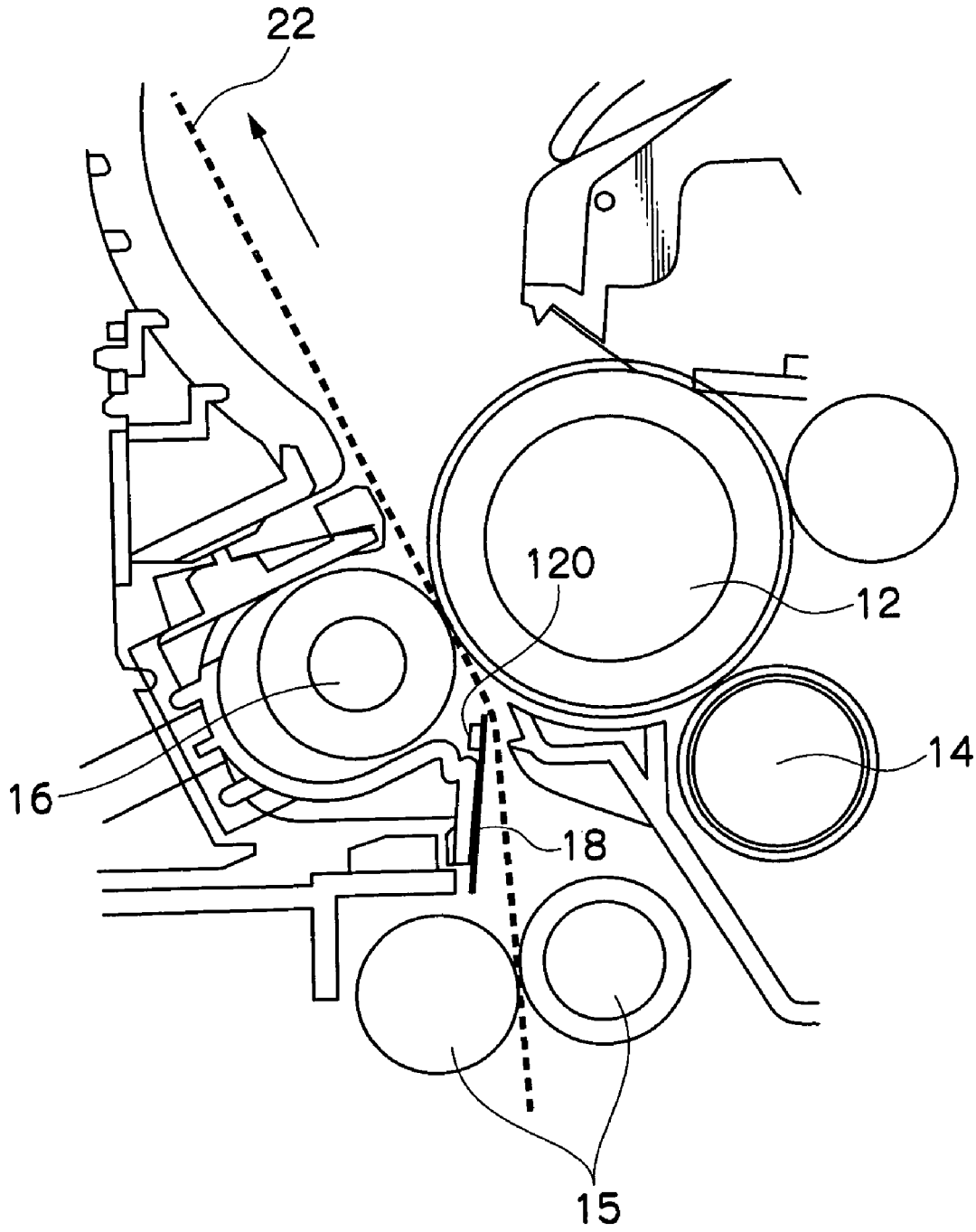
FIG. 14 is a drawing illustrating a transfer section of the image recording device according to the sixth embodiment of the invention.

As illustrated in FIG. 13, a surface of the photoconductor drum 12 is charged by the charger 8 and an image exposure is carried out by the ROS 6. An electrostatic latent image obtained by exposure is developed as a toner image with a developing roller 14 of a developer 10. Constitution of this transfer unit is generally as same as that of FIG. 1 with reference to the first embodiment, excepting for the self-discharge type antistatic member 120.

That is, a toner image formed on the photoconductor drum 12 is transferred on the paper 22 nipped between the transfer roller 16 and the photoconductor drum 12 then feed.

In the occasion, voltage having a polarity that is the same as that of the toner is applied on the self-discharge type antistatic member 120 which is the charge producing section applying PTB (Pre Transfer Bias) and provided so as not to contact to the paper 22. Thereby, an electric field of a direction directed from the self-discharge type antistatic member 120 to the transfer nip portion A is formed to a toner to transfer from a surface of the photoconductor drum 12 to the paper 22. In this occasion, there is no shielding matter obstructing an electric field between a self-discharge type antistatic member 120 and the transfer nip portion A, therefore, the electric field generated in the self-discharge type antistatic member 120 directly reaches the transfer nip portion A.

Thereby, as understood from a description concerning FIG. 4 of the first embodiment and FIG. 16 of the sixth embodiment, the force is applied to a direction to push back the toners scattered to an upstream direction by the above mentioned electric field having a polarity that is the same as that of the toner, thereby, scattering (blur) of the toner to a feeding direction upstream side, that is a backward of the toner image is controlled.

Figures 15A, 15B:
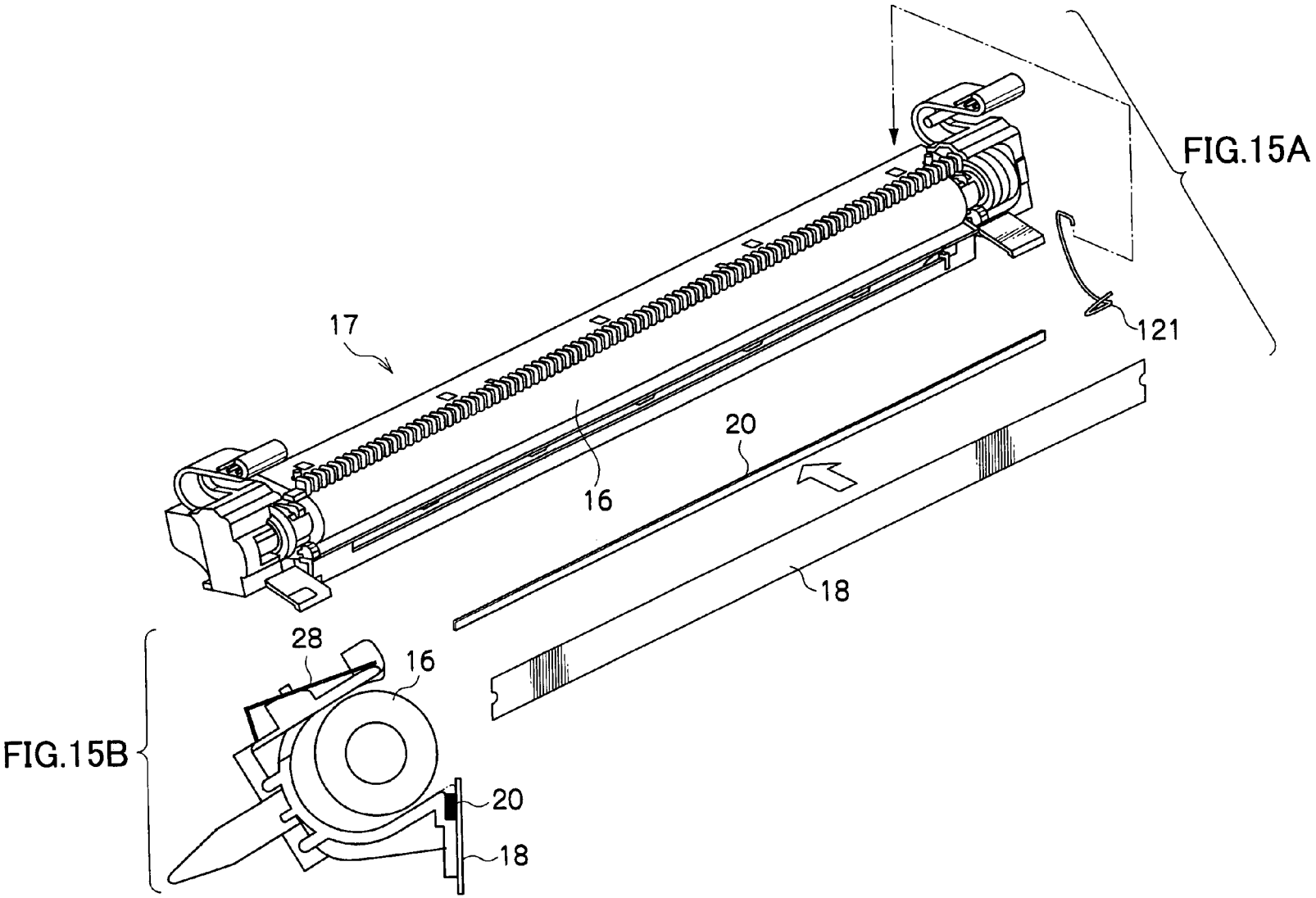
FIG. 15 is a perspective view illustrating a transfer section of the image recording device according to the sixth embodiment of the invention.

A transfer unit of the image recording device according to the sixth embodiment of the invention is illustrated in FIG. 15.

As generally similar to a constitution in FIG. 3 of the first embodiment, as illustrated in FIG. 15, a self-discharge type antistatic member 120 is installed in a feeding direction upstream side of the transfer unit 17 holding the transfer roller 16 in parallel with the conveying surface, and the shielding member 18 is provided between the conveying surface and the self-discharge type antistatic member 120, and the paper 22 and a self-discharge type antistatic member 120 are held so as not to contact to each other. Further, a non-contacting relation between a self-discharge type antistatic member 120 and the transfer roller 16 is further maintained.

Furthermore, in this the sixth embodiment, a new voltage supply section for a self-discharge type antistatic member 120 is not provided, and voltage supplied to an antistatic member 28 (DTS) described below is utilized, and, voltage is supplied to a self-discharge type antistatic member 120 in the load dispatching member 21 which diverged from a voltage feed path to the antistatic member 28, and, a transfer unit 17 is formed by uniting the antistatic section 28, the transfer roller 16, a self-discharge type antistatic member 120, the shielding member 18. Thereby, enhancement of assembling characteristics, decreasing of the number of parts, and cost reduction can be realized.

Further, concerning the above-mentioned matter, the image recording device according the present embodiment is constituted so that leak is generated the transfer roller 16 and a load dispatching path for the antistatic member such as the antistatic member 120 at voltage lower than voltage starting voltage between the antistatic member 120 and the transfer roller 16.

Accordingly, even if a leak is generated by any reasons, a leak generating position can be restricted between the transfer roller 16 and the load dispatching path for the antistatic member such as the load dispatching member 121, therefore, a more high-security constitution can be realized.

Material of Antistatic Member

As a material used in the above mentioned self-discharge type antistatic member 120, as long as it has a linear form, a wire wound with an antistatic fabric knit with a conductive fiber (trade name "ST poly") for countermeasure against static electricity may be used, or, a conductive fiber (trade name "BEKISTAD") of which a blended yarn of a metal fiber and a chemical fiber is processed in the shape of string may be used without modification.

Further, if it is a form of strip-shaped, an antistatic fabric knit with the above mentioned conductive fiber (trade name "DENKITHOL") without modification.

The charge production section of the image recording device according to the sixth embodiment of the invention is illustrated in FIG. 16.

Similarly to the description in FIG. 4 according to the first embodiment, in the invention, as illustrated in FIG. 16A, the a self-discharge type antistatic member 120 which is the charge producing section is provided near a background of the paper 22 of a feeding direction upstream side from a nip position A of the paper 22, and by applying voltage having a polarity that is the same as that of the toner 40, an electric field of a direction from the self-discharge type antistatic member 120 to the transfer nip portion A is formed, and repelled with toner 40 electrically, therefore, blur can be prevented by pushed back the toner 40 (reason of blur) which is going to be flown to a feeding direction upstream side (right side of the drawing) in a feeding direction downstream side (a left side out of the drawing) as illustrated in FIG. 16B (a dotted arrow), and by transferring the toner at the correct position.

The transfer unit of the image recording device according to the seventh embodiment of the invention is illustrated in FIG. 17. FIG. 17 corresponds to FIG. 5 according to the second embodiment except self-discharge type antistatic members 1201 and 1202.

That is, as illustrated in FIG. 17, a self-discharge type antistatic member 1201 is provided between the first intermediate transfer roller 24A and the second intermediate transfer roller 26 at rotational direction upstream side from a contact position, an electric field of a direction toward a rotational direction downstream side (right bottom of the drawing) of the first intermediate transfer roller 24A and the second intermediate transfer roller 26 is formed, and repelled with the toner electrically, therefore, blur when two colored image is transferred from the first intermediate transfer roller 24A to the second intermediate transfer rollers 26 can be prevented by pushed back the toner which is going to be flown to rotational direction upstream side (left upper of the drawing) in rotational direction downstream side, and transferring the toner at the correct position.

Similarly, a self-discharge type antistatic member 1202 is provided between the first intermediate transfer roller 24B and the second intermediate transfer roller 26 at rotational direction upstream side from a contact position, an electric field of a direction toward a rotational direction downstream side (left bottom of the drawing) of the first intermediate transfer roller 24B and the second intermediate transfer roller 26 is formed, and repelled with the toner electrically, therefore, blur when two colored image is transferred from the first intermediate transfer rollers 24B to the second intermediate transfer rollers 26 can be prevented by pushed back the toner which is going to be flown to rotational direction upstream side (right upper of the drawing) in rotational direction downstream side, and transferring the toner at the correct position.

The transfer unit of the image recording device according to the eighth embodiment of the invention is illustrated in FIG. 18. FIG. 18 corresponds to FIG. 6 according to the third embodiment except the self-discharge type antistatic member 120.

The transfer unit of the image recording device according to the ninth embodiment of the invention is illustrated in FIG. 19. FIG. 19 corresponds to FIG. 7 according to the fourth embodiment except the self-discharge type antistatic member 120.

The transfer unit of the image recording device according to the tenth embodiment of the invention is illustrated in FIG. 20. FIG. 20 corresponds to FIG. 8 according to the fifth embodiment except the self-discharge type antistatic member 120.

Other Configuration

Embodiments of the invention is described above, however, the invention is not limited to the above mentioned embodiment at all, and it will be appreciated that the invention can be carried out in various aspects in a range without deviating a subject matter of the invention.

That is, in the image forming device according to the invention, the paper 22 to be fed is not limited to so-called a paper. Further, it can be applied to other various devices as well as the image forming device, as long as a device to feed a sheet and transfer powders by electrostatic force.

Moreover, the following aspects can be employed concretely.

In the image forming device according to the first aspect, voltage having a polarity equal to a charging polarity of the toner may be applied to the charge producing section.

In the invention having the above mentioned constitution, an antistatic effect of the charge producing section is further enhanced and blur can be controlled more effectively.

In the image forming device according to the first aspect, a shielding member may be provided between the charge producing section and the transfer receiving body.

In the invention having the above mentioned constitution, poor transfer of the hydrous paper can be prevented by suppressing supply of charge from the charge producing section to the paper and preventing a transfer condition from being changed.

In the image forming device of the first aspect, the shielding member may be a conveying member forming a conveying surface for the transfer receiving body.

In the invention having the above mentioned constitution, the shielding member is also served as the conveying member forming the conveying surface of the transferred material, therefore, the number of parts can be reduced and a low cost can be achieved.

In the image forming device according to the first aspect, the shielding member may have a flexibility.

In the invention having the above mentioned constitution, the shielding member has flexibility, therefore, even if a thick paper is fed, a feeding property can be secured without increasing a feeding resistance of the shielding member and the thick paper.

In the image forming device according to the first aspect, the charge producing section may be a wire-shaped conductive member.

In the invention having the above mentioned constitution, space saving can be intended by suppressing a cross section of the charge producing section.

In the image forming device according to the first aspect, the charge producing section may be a load dispatching member constituting a circuit supplying electric power to other parts.

In the invention having the above mentioned constitution, the number of parts can be reduced and a low cost can be achieved.

In the image forming device according to the first aspect, the charge producing section may be energized through a resistor.

In the invention having the above mentioned constitution, an effect to prevent poor transfer by poor electrification of a hydrous paper in high humidity is provided, and a blur suppressing effect in low temperature and low humidity can be enhanced.

In the image forming device according to the first aspect, an electric current detecting section detecting electric current that flows in the charge producing section may be provided, and voltage applied to the charge producing section is controlled depending on the electric current detected in the electric current detecting section.

In the invention having the above mentioned constitution, an effect to prevent poor transfer by poor electrification of a hydrous paper in high humidity is provided, and a blur suppressing effect in low temperature and low humidity can be enhanced by adjusting voltage.

In the image forming device according to the first aspect, an antistatic section may be provided at a moving direction downstream side of the transfer section so as not to be contacted with the transfer receiving body, and voltage having a polarity that is the same as that of the antistatic section is applied to the charge producing section.

In the invention having the above mentioned constitution, power source can be used in common between the charge producing section and an antistatic section for peeling the paper, the number of parts can be reduced and a low cost can be achieved.

In the image forming device according to the first aspect, a length of the charge producing section may be shorter than a length of the transfer section.

In the invention having the above mentioned constitution, a creeping distance between the charge producing section and a conductive member such as an edge bearing of a transfer section can be taken largely, therefore, generation of leak or the like can be suppressed.

In the image forming device according to the first aspect, the charge producing section may be energized through an energizing member made of a conductive resin.

In the invention having the above mentioned constitution, an effect to prevent poor transfer by poor electrification of a hydrous paper in high humidity is provided, and a blur suppressing effect in low temperature and low humidity can be enhanced, in addition, the number of parts can be reduced and a low cost can be achieved.

In the image forming device according to the first aspect, an electric current detecting section detecting electric current that flows in the charge producing section may be provided, and voltages applied to the antistatic section and the charge producing section, respectively, or voltage applied to the charge producing section are/is controlled depending on the electric current detected in the electric current detecting section.

In the invention having the above mentioned constitution, an effect to prevent poor transfer by poor electrification of a hydrous paper in high humidity is provided, and a blur suppressing effect in low temperature and low humidity can be enhanced with maintaining a paper peeling effect.

In the image forming device according to the first aspect, an image forming process may be carried out while switching among a plurality of processing speeds, and voltage applied to the charge producing section is regulated depending on a selected processing speed.

In the invention having the above mentioned constitution, a low speed of which poor transfer tends to be generated and a high speed of which blur tends to be generated are switched per a detected processing speed, and the voltage which is most suitable for the charge producing section can be applied.

Further, in the image forming device of the second aspect, the antistatic member may be grounded.

In the invention having the above mentioned constitution, an antistatic effect of the antistatic member can be further enhanced and blur can be suppressed more effectively.

In the image forming device according to the second aspect, voltage having a polarity equal to a charging polarity of the toner may be applied to the antistatic member.

In the invention having the above mentioned constitution, an antistatic effect of the antistatic member can be further enhanced and blur can be suppressed more effectively.

In the image forming device according to the second aspect, a shielding member having an insulating property may be provided between the antistatic member and the transfer receiving body.

In the invention having the above mentioned constitution, supply of charge from the antistatic member to the paper can be suppressed, and poor transfer of a hydrous paper can be prevented.

In the image forming device according to the second aspect, the shielding member may be a conveying member forming a conveying surface for the transfer receiving body.

In the invention having the above mentioned constitution, the shielding member is also served as the conveying member forming the conveying surface of the transfer receiving body, therefore, the number of parts can be reduced and a low cost can be achieved.

In the image forming device according to the second aspect, the shielding member may have flexibility.

In the invention having the above mentioned constitution, the shielding member has flexibility, therefore, even if a thick paper is fed, a feeding property can be secured without increasing a feeding resistance of the transfer material.

In the image forming device according to the second aspect, an antistatic section may be provided at a moving direction downstream side of the transfer section so as not to be contacted with the transfer receiving body, and voltage having a polarity that is the same as that of the antistatic section is applied to the antistatic member.

In the invention having the above mentioned constitution, power source can be used in common between the antistatic member and the antistatic section for peeling the paper, the number of parts can be reduced and a low cost can be achieved.

In the image forming device of the second aspect, the antistatic member may be energized through a resistor.

In the invention having the above mentioned constitution, an effect to prevent poor transfer by poor electrification of a hydrous paper in high humidity is provided, and a blur suppressing effect in low temperature and low humidity can be enhanced.

In the image forming device of the second aspect, the image recording device may include an environment detecting section detecting an environmental condition in the device or around the device, and voltage applied to the antistatic member is controlled depending on the environmental condition detected in the environment detecting section.

In the invention having the above mentioned constitution, suitable voltage per the detected environment can be applied.

In the image forming device of the second aspect, the image recording device may include a characteristic value detecting section detecting a characteristic value in the device that fluctuates according to an environmental condition in the device or around the device, and voltage applied to the antistatic member is controlled depending on the characteristic value detected in the characteristic value detecting section.

In the invention having the above mentioned constitution, suitable voltage per the detected characteristic value can be applied.

In the image forming device of the second aspect, the image recording device may include a sensor section identifying a type of the transfer receiving body, and voltage applied to the antistatic member is controlled depending on a type of the transfer receiving body sensed in the sensor section.

In the invention having the above mentioned constitution, suitable voltage per the detected paper type can be applied.

In the image forming device of the second aspect, the antistatic member may be linear.

In the invention having the above mentioned constitution, a required space can be decreased by decreasing a cross section of the antistatic member.

In the image forming device of the second aspect, the linear antistatic member may be a wire wound with an antistatic fabric.

In the invention having the above mentioned constitution, installation property and assembling property of the antistatic member can be improved.

In the image forming device of the second aspect, the linear antistatic member may be a conductive fiber.

In the invention having the above mentioned constitution, a required space can be decreased by decreasing a cross section of the antistatic member.

In the image forming device of the second aspect, the antistatic member may have a strip-shape.

In the invention having the above mentioned constitution, the antistatic member can be easily attached precisely, and mass productivity is improved.

In the image forming device of the second aspect, the strip-shaped antistatic member may be an antistatic non-woven fabric.

In the invention having the above mentioned constitution, a low cost can be achieved by using an antistatic nonwoven fabric.

In the image forming device of the second aspect, a length of the antistatic member may be shorter than a length of the transfer section.

In the invention having the above mentioned constitution, a creeping distance between the antistatic member and a conductive member such as an edge bearing of a transfer section can be taken largely, therefore, generation of leak or the like can be suppressed.

In the image forming device of the second aspect, leak starting voltage between the transfer section and the load dispatching path of the antistatic member may be smaller than leak starting voltage between the transfer section and the antistatic member.

In the invention having the above mentioned constitution, leak is generated between the load dispatching path and the transfer section at voltage lower than voltage of which leak is generated between the antistatic member and the transfer section, therefore, generation of leak in the antistatic member can be prevented.

In the image forming device of the second aspect, the transfer section may be formed as a unit integrally including an antistatic section, the transfer section, the antistatic member and the shielding member.

In the invention having the above mentioned constitution, the number of parts can be reduced and a low cost can be achieved.

In the image forming device of the second aspect, an electric field of the antistatic member may directly reach a nip position between the transfer section and the image carrying body.

In the invention having the above mentioned constitution, blur suppressing effect by the antistatic member can be performed at a maximum.

What is claimed is:

1. An image forming device which transfers a toner image carried on an image carrying body from the image carrying body to a transfer receiving body in a transfer section, the device comprising a charge producing section provided at an upstream side, in a moving direction of the transfer receiving body, with respect to a position at which the image carrying body and the transfer receiving body oppose each other so as not to be contacted with the transfer receiving body, wherein a shielding member is provided between the charge producing section and the transfer receiving body, so as to separate the charge producing section from the transfer receiving body by a predetermined distance and to prevent the transfer receiving body from being charged by the charge producing section.

2. The image forming device of claim 1, wherein voltage having a polarity equal to a charging polarity of the toner is applied to the charge producing section.

3. The image forming device of claim 1, wherein the shielding member is a conveying member forming a conveying surface for the transfer receiving body.

4. The image forming device of claim 1, wherein the shielding member has a flexibility.

5. The image forming device of claim 1, wherein the charge producing section is a wire-shaped conductive member.

6. The image forming device of claim 1, wherein the charge producing section is a load dispatching member constituting a circuit supplying electric power to other parts.

7. The image forming device of claim 1, wherein the charge producing section is energized through a resistor.

8. The image forming device of claim 1, wherein an electric current detecting section detecting electric current that flows in the charge producing section is provided, and voltage applied to the charge producing section is controlled depending on the electric current detected in the electric current detecting section.

9. The image forming device of claim 1, wherein an antistatic section is provided at a moving direction downstream side of the transfer section so as not to be contacted with the transfer receiving body, and voltage having a polarity that is the same as that of the antistatic section is applied to the charge producing section.

10. The image forming device of claim 1, wherein a length of the charge producing section is shorter than a length of the transfer section.

11. The image forming device of claim 1, wherein the charge producing section is energized through an energizing member made of a conductive resin.

12. The image forming device of claim 9, wherein an electric current detecting section detecting electric current that flows in the charge producing section is provided, and voltages applied to the antistatic section and the charge producing section, respectively, or voltage applied to the charge producing section are/is controlled depending on the electric current detected in the electric current detecting section.

13. The image forming device of claim 1, wherein an image forming process is carried out while switching among a plurality of processing speeds, and voltage applied to the charge producing section is regulated depending on a selected processing speed.

14. An image forming device which transfers a toner image carried on an image carrying body from the image carrying body to a transfer receiving body at a transfer section, wherein a self-discharge type antistatic member is provided so as not to be contacted with the transfer receiving body at an upstream side, in a moving direction of the transfer receiving body, with respect to a position at which the image carrying body and the transfer receiving body oppose each other, wherein a shielding member having an insulating property is provided between the antistatic member and the transfer receiving body, so as to separate the antistatic member from the transfer receiving body by a predetermined distance and to prevent the transfer receiving body from being charged by the antistatic member.

15. The image recording device of claim 14, wherein the antistatic member is grounded.

16. The image recording device of claim 14, wherein voltage having a polarity equal to a charging polarity of the toner is applied to the antistatic member.

17. The image recording device of claim 14, wherein the shielding member is a conveying member forming a conveying surface for the transfer receiving body.

18. The image recording device of claim 17, wherein the shielding member has flexibility.

19. The image recording device of claim 14, wherein an antistatic section is provided at a moving direction downstream side of the transfer section so as not to be contacted with the transfer receiving body, and voltage having a polarity that is the same as that of the antistatic section is applied to the antistatic member.

20. The image recording device of claim 16, wherein the antistatic member is energized through a resistor.

21. The image recording device of claim 16, wherein the image recording device comprises an environment detecting section detecting an environmental condition in the device or around the device, and voltage applied to the antistatic member is controlled depending on the environmental condition detected in the environment detecting section.

22. The image recording device of claim 16, wherein the image recording device comprises a characteristic value detecting section detecting a characteristic value in the device that fluctuates according to an environmental condition in the device or around the device, and voltage applied to the antistatic member is controlled depending on the characteristic value detected in the characteristic value detecting section.

23. The image recording device of claim 16, wherein the image recording device comprises a sensor section identifying a type of the transfer receiving body, and voltage applied to the antistatic member is controlled depending on a type of the transfer receiving body sensed in the sensor section.

24. The image recording device of claim 14 wherein the antistatic member is linear.

25. The image recording device of claim 24, wherein the linear antistatic member is a wire wound with an antistatic fabric.

26. The image recording device of claim 24, wherein the linear antistatic member is a conductive fiber.

27. The image recording device of claim 14, wherein the antistatic member has a strip-shape.

28. The image recording device of claim 27, wherein the strip-shaped antistatic member is an antistatic non-woven fabric.

29. The image recording device of claim 14, wherein a length of the antistatic member is shorter than a length of the transfer section.

30. The image recording device of claim 14, wherein leak starting voltage between the transfer section and the load dispatching path of the antistatic member is smaller than leak staffing voltage between the transfer section and the antistatic member.

31. The image recording device of claim 14, wherein the transfer section is formed as a unit integrally comprising an antistatic section, the transfer section, the antistatic member and the shielding member.

32. The image recording device of claim 14, wherein an electric field of the antistatic member directly reaches a nip position between the transfer section and the image carrying body.

33. The image forming device of claim 1, wherein the shielding member is configured to shield an electric field.

34. The image recording device of claim 14, wherein the shielding member is configured to shield an electric field.

* * * * *